US007232268B2

(12) United States Patent
Sugimoto et al.

(10) Patent No.: US 7,232,268 B2
(45) Date of Patent: Jun. 19, 2007

(54) ROLL SHEET HOLDER AND TAPE PRINTER

(75) Inventors: Kiyoshi Sugimoto, Kuwana (JP); Akira Sago, Seto (JP); Keiji Seo, Nagoya (JP); Atsushi Kasugai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/439,182

(22) Filed: May 24, 2006

(65) Prior Publication Data

US 2006/0210343 A1 Sep. 21, 2006

Related U.S. Application Data

(63) Continuation of application No. 10/974,671, filed on Oct. 28, 2004, now Pat. No. 7,070,348.

(30) Foreign Application Priority Data

Jan. 6, 2004 (JP) ..... 2004-001036

(51) Int. Cl.
*B41J 11/26* (2006.01)

(52) U.S. Cl. ..... 400/242; 400/243; 400/88; 242/357; 242/570

(58) Field of Classification Search ..... 400/88, 400/242, 243, 244, 249, 246; 242/357, 570, 242/597.4
See application file for complete search history.

(56) References Cited

U.S. PATENT DOCUMENTS

| | | | | |
|---|---|---|---|---|
| 5,884,860 | A | 3/1999 | Ishikawa et al. | |
| 6,099,179 | A | 8/2000 | Higashi et al. | |
| 6,158,342 | A * | 12/2000 | Moore | 101/407.1 |
| 6,261,013 | B1 * | 7/2001 | Bryer et al. | 400/613 |
| 6,431,492 | B1 * | 8/2002 | Chillscyzn | 242/577 |
| 6,533,476 | B2 | 3/2003 | Hamisch et al. | |
| 6,609,844 | B1 | 8/2003 | Petteruti et al. | |
| 6,695,500 | B2 * | 2/2004 | Kim et al. | 400/613 |
| 6,786,660 | B1 | 9/2004 | Woosley et al. | |
| 7,070,348 | B2 * | 7/2006 | Sugimoto et al. | 400/244 |
| 7,104,712 | B2 * | 9/2006 | Sugimoto et al. | 400/613 |

FOREIGN PATENT DOCUMENTS

| | | |
|---|---|---|
| JP | A 03-019047 | 2/1991 |
| JP | A 2000-313549 | 11/2000 |
| JP | A 2002-096515 | 4/2002 |
| JP | A 2003-011453 | 1/2003 |
| JP | A 2004-262588 | 9/2004 |

* cited by examiner

*Primary Examiner*—Daniel J. Colilia
*Assistant Examiner*—Kevin D. Williams
(74) *Attorney, Agent, or Firm*—Oliff & Berridge, PLC

(57) ABSTRACT

A tape printer includes a roll sheet holder storage part of which a bottom is formed with a positioning recess which is rectangular in plan view and long sideways and has a predetermined depth. A discrimination recess rectangular in plan view is provided between the positioning recess and an inner base end of a holder support member). The discrimination recess fittingly receives a sheet discrimination part extending in a predetermined length from a lower end of the positioning holding member inward at substantially right angle thereto. The sheet discrimination part is formed with sensor holes arranged in an L-shaped pattern. In the discrimination recess, there are provided sheet discrimination sensors arranged in an L-shaped pattern.

6 Claims, 17 Drawing Sheets

3
20
44
45
36
40
43
42
60
48
35
47
12
13
37
55
56
57
12A
43A
43B
43C
Y
Z
10m
20m
30m
62

12
13
55
12A
56
37
50
62
60B
60
60A
60C
60D
60E

ROLL SHEET HOLDER AND TAPE PRINTER

This is a Continuation of application Ser. No. 10/974,671 filed Oct. 28, 2004 now U.S. Pat. No. 7,070,348. The disclosure of the prior application is incorporated by reference herein in its entirety.

BACKGROUND OF THE INVENTION

1. Field of the Invention

The present invention relates to a roll sheet holder which rotatably holds a roll sheet wound on a cylindrical sheet core and is removably mounted in a tape printer provided with a feeding device for feeding the roll sheet and a printing unit for printing on the roll sheet. Further, the present invention relates to a tape printer in which the roll sheet holder is removably mounted.

2. Description of Related Art

Heretofore, various types of tape printers have been proposed to print characters and others on a long sheet formed of a self-adhesive sheet applied with a release sheet by means of a thermal head. Some tape printers of this type are provided with a roll sheet wound on a sheet core, a roll sheet holder which rotatably holds therein the sheet core, a support mechanism which removably mounts the roll sheet holder in the tape printer, and a feeding device for feeding part of the roll sheet while drawing the roll sheet from the roll sheet holder. The roll sheet holder may be selected from among plural holders of different sizes individually corresponding to various sheet widths.

One of the roll sheet holders mounted in the tape printer is disclosed in Japanese utility model unexamined publication No. H3-19047 (1997-19407). This is a recording sheet holding case made of a heat insulating material and for storing a roll of a thermal recording sheet wound on a sheet core. This holding case is constructed of a mechanism for supporting both ends of the sheet core, a recording sheet drawing port through which part of the thermal recording sheet is unwound, and pits and projections formed on an outer surface of the case to indicate the kind of thermal recording sheet stored in the case.

For image recording, the tape printer using the recording sheet holding case constructed as above can distinguish the kind of thermal recording sheet stored in the sheet holding case by means of a microswitch or the like provided in the bottom of the sheet holding case and thereby control the application of electric power to a thermal head. Accordingly, images can be printed at an appropriate color density on the thermal recording sheet mounted in the printer.

However, the conventional tape printer in which the above mentioned recording sheet holding case is mounted has the following disadvantages. When part of the thermal recording sheet is unwound, the holding case is caused to rotate in a direction of drawing of the sheet. Accordingly, lower end faces of the projections of the holding case whereby the microswitch is pressed down are moved up to come off the microswitch. This may cause a problem that images are printed at an inappropriate color density on the thermal recording sheet.

SUMMARY OF THE INVENTION

The present invention has been made in view of the above circumstances and has an object to overcome the above problems and to provide a roll sheet holder which can be prevented from rotating in a direction of drawing a roll sheet from the holder to hold a bottom of the roll sheet holder against upward dislocation.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a roll sheet holder which holds a roll sheet wound on a cylindrical sheet core having a through hole opening at both ends and is removably mountable in a tape printer which includes a feeding device which draws the roll sheet to feed an unwound part thereof, a printing device which prints on the part of the roll sheet fed by the feeding device, the roll sheet holder comprising: a guide member including a first cylindrical part which is formed with a cylindrical through hole and is fitted in one open end of the sheet core and a first flange part which is formed in an outer periphery of an outer end face of the first cylindrical part and is brought into contact with one end face of the roll sheet; a positioning holding member which is arranged in contact with the other end face of the roll sheet and formed with a second cylindrical part on an inner surface, the second cylindrical part being fitted in the other open end of the sheet core; a shaft including a first end which is fitted in the through hole of the first cylindrical part of the guide member and is provided with a second flange part fixed in contact with an outer surface of the first flange part and a second end which is fitted in the second cylindrical part to be fixed to the positioning holding member; wherein the roll sheet holder is mountable in the tape printer which includes an insertion opening in which the unwound part of the roll sheet is inserted and a support portion provided upstream of the insertion opening in a direction of feeding the unwound part of the roll sheet; the first flange part includes: a first extended portion extending downward in a predetermined length from a lower periphery of the outer end face of the first cylindrical part, the first extended portion being brought into contact with a bottom surface of the tape printer when the roll sheet holder is mounted therein; and a frontward extended portion formed extending downstream in a direction of drawing the roll sheet from the outer periphery of the outer end face of the first cylindrical part to have a front end which is located outside of an outermost surface of the roll sheet of a maximum diameter and have a lower edge which is brought into contact with an upper surface of the support portion when the roll sheet holder is mounted in the tape printer; and the roll sheet holder is arranged to unwind the roll sheet from above the sheet core and inserted in the insertion opening when the roll sheet holder is mounted in the tape printer.

According to the above roll sheet holder, one end of the sheet core on which the roll sheet is wound is fixed to the first flange part so that one end face of the roll sheet is held in contact with the first flange part. When the roll sheet holder is mounted in the tape printer, the lower edge of the frontward extended portion of the first flange part is brought into contact with the upper surface of the support position provided upstream of the insertion opening in which the unwound part of the roll sheet is to be inserted. Then, the roll sheet is drawn from above the sheet core and inserted in the insertion opening. With the frontward extended portion whose lower edge is in contact with the upper surface of the support portion, the roll sheet holder can be prevented from rotating in a direction of drawing the roll sheet when the roll sheet is drawn. This makes it possible to reliably hold the bottom of the roll sheet holder against upward dislocation.

According to another aspect, the invention provides a tape printer including a roll sheet wound on a cylindrical sheet core having a through hole opening at both ends, a feeding device which draws the roll sheet to feed an unwound part thereof, and a printing device which prints on the part of the roll sheet fed by the feeding device, the tape printer comprising: a roll sheet holder which holds the roll sheet wound on the sheet core, the roll sheet holder including: a guide member including a first cylindrical part which is formed with a cylindrical through hole and is fitted in one open end of the sheet core and a first flange part which is formed in an outer periphery of an outer end face of the first cylindrical part and is brought into contact with one end face of the roll sheet; a positioning holding member which is arranged in contact with the other end face of the roll sheet and formed with a second cylindrical part on an inner surface, the second cylindrical part being fitted in the other open end of the sheet core; a cylindrical shaft including a first end which is fitted in the through hole of the first cylindrical part of the guide member and is provided with a second flange part fixed in contact with an outer surface of the first flange part and a second end which is fitted in the second cylindrical part to be fixed to the positioning holding member; the first flange part including: a first extended portion extending downward in a predetermined length from a lower periphery of an outer end face of the first cylindrical part, the extended portion being brought into contact with a bottom surface of the tape printer when the roll sheet holder is mounted therein; and a frontward extended portion formed extending downstream in a direction of drawing the roll sheet from the outer periphery of the outer end face of the first cylindrical part to have a front end which is located outside of an outermost surface of the roll sheet of a maximum diameter; and insertion opening in which the unwound part of the roll sheet is inserted; and a support mechanism which removably supports the roll sheet holder in the tape printer, the support mechanism including: a support portion which is provided upstream of the insertion opening in a direction of feeding the unwound part of the roll sheet and has an upper surface with which a lower edge of the frontward extended portion of the guide member of the roll sheet holder is brought into contact when the roll sheet holder is mounted in the tape printer; wherein the roll sheet holder is arranged to unwind the roll sheet from above the sheet core and inserted in the insertion opening when the roll sheet holder is mounted in the tape printer.

In the above tape printer, the support mechanism which removably supports the roll sheet holder within the tape printer is provided with the support portion at a position upstream of the insertion opening in the feeding direction. In the roll sheet holder, one end of the sheet core on which the roll sheet is wound is fixed to the first flange part so that one end face of the roll sheet is held in contact with the first flange part. When the roll sheet holder is mounted in the tape printer, the lower edge of the frontward extended portion of the first flange part is brought into contact with the upper surface of the support position and the roll sheet is drawn from above the sheet core and inserted in the insertion opening. With the frontward extended portion whose lower edge is in contact with the upper surface of the support portion, the roll sheet holder can be prevented from rotating in a direction of drawing the roll sheet when the roll sheet is drawn therefrom. This makes it possible to reliably hold the bottom of the roll sheet holder against upward dislocation.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a roll sheet holder and a tape printer embodying the present invention will now be given referring to the accompanying drawings.

[First Embodiment]

A first embodiment of the tape printer is first explained below with reference to FIGS. 1 through 7.

Figure 1:
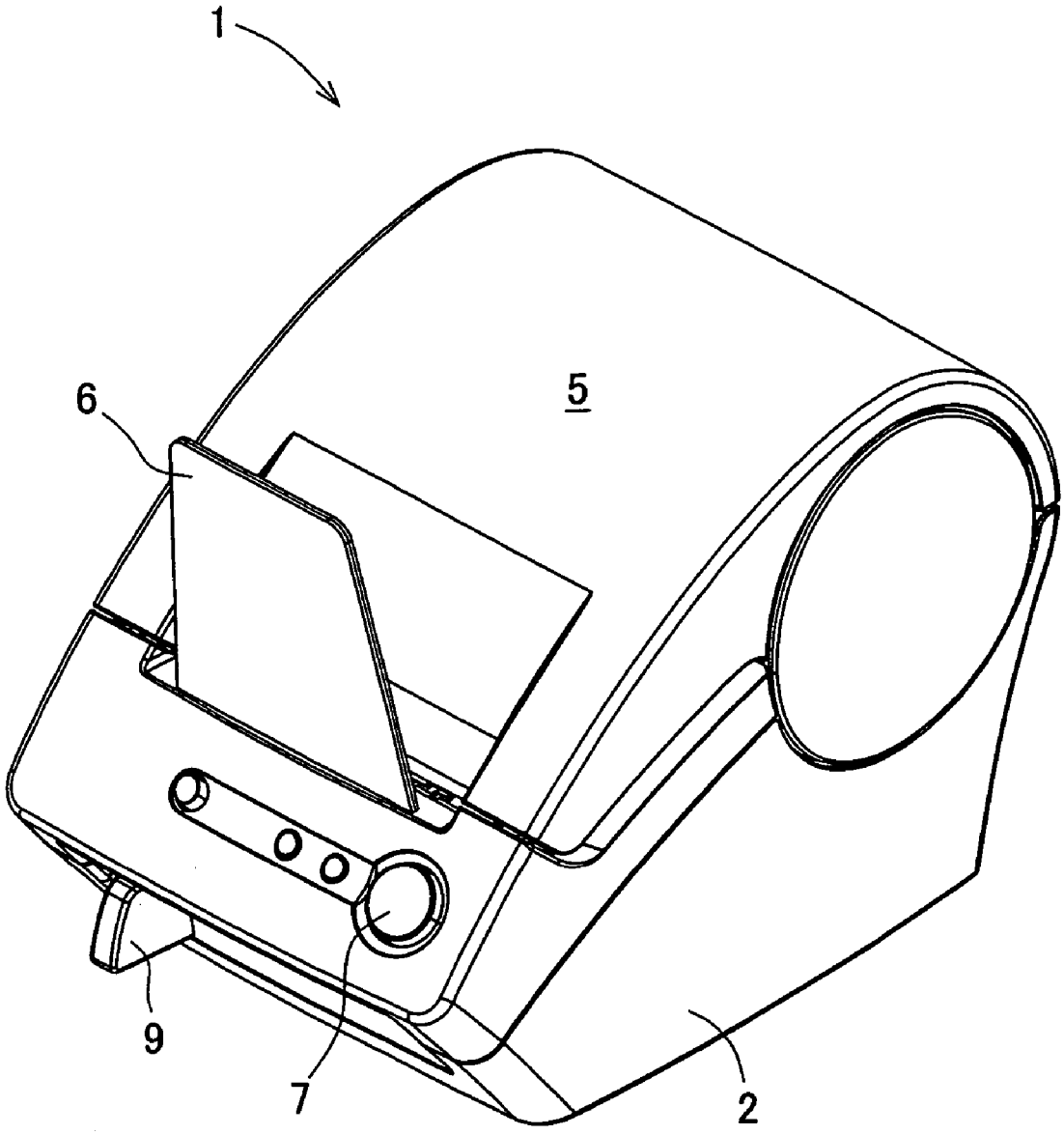
FIG. 1 is a schematic perspective view of a tape printer in a first embodiment.
Figure 2:
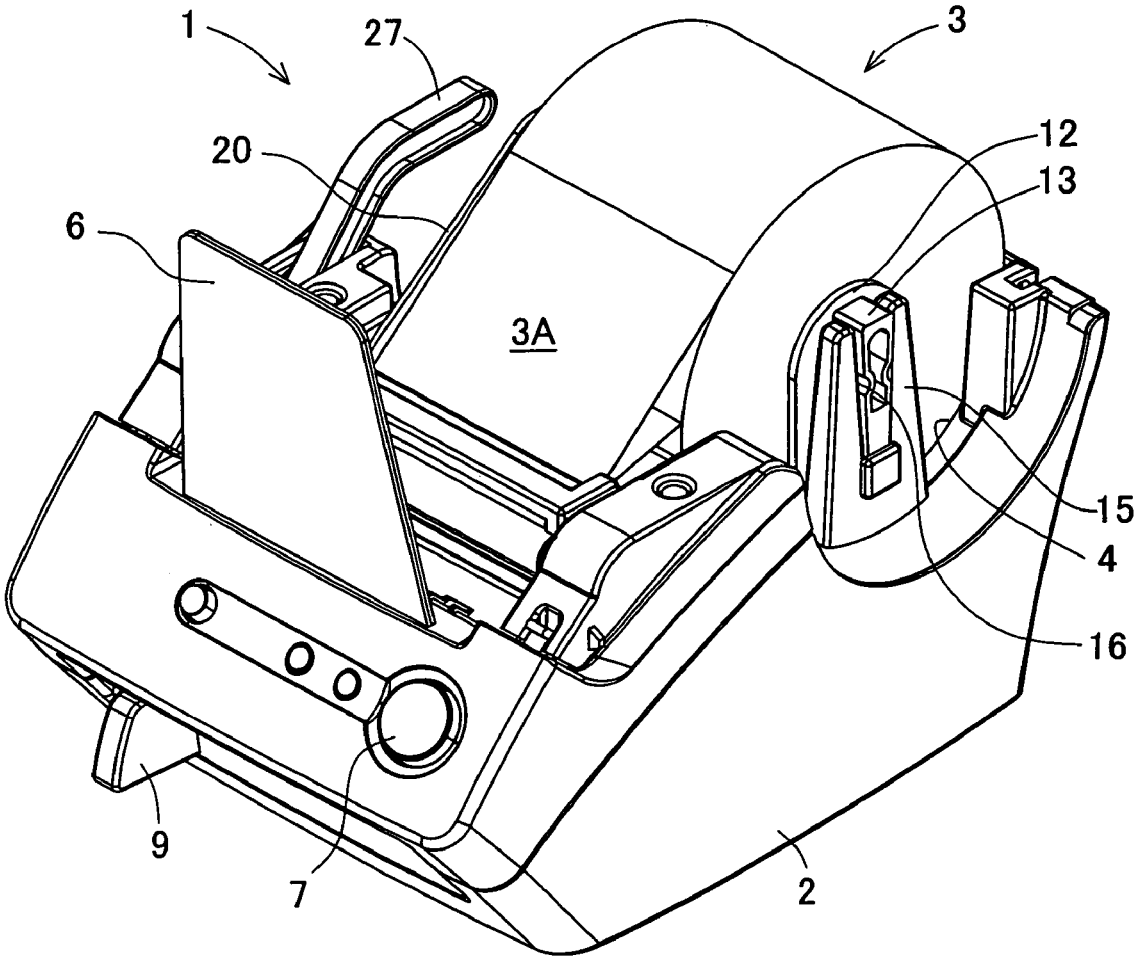
FIG. 2 is a perspective view of the tape printer of which a top cover is removed, in which a roll sheet holder holding a roll sheet of a maximum width is mounted.
Figure 3:
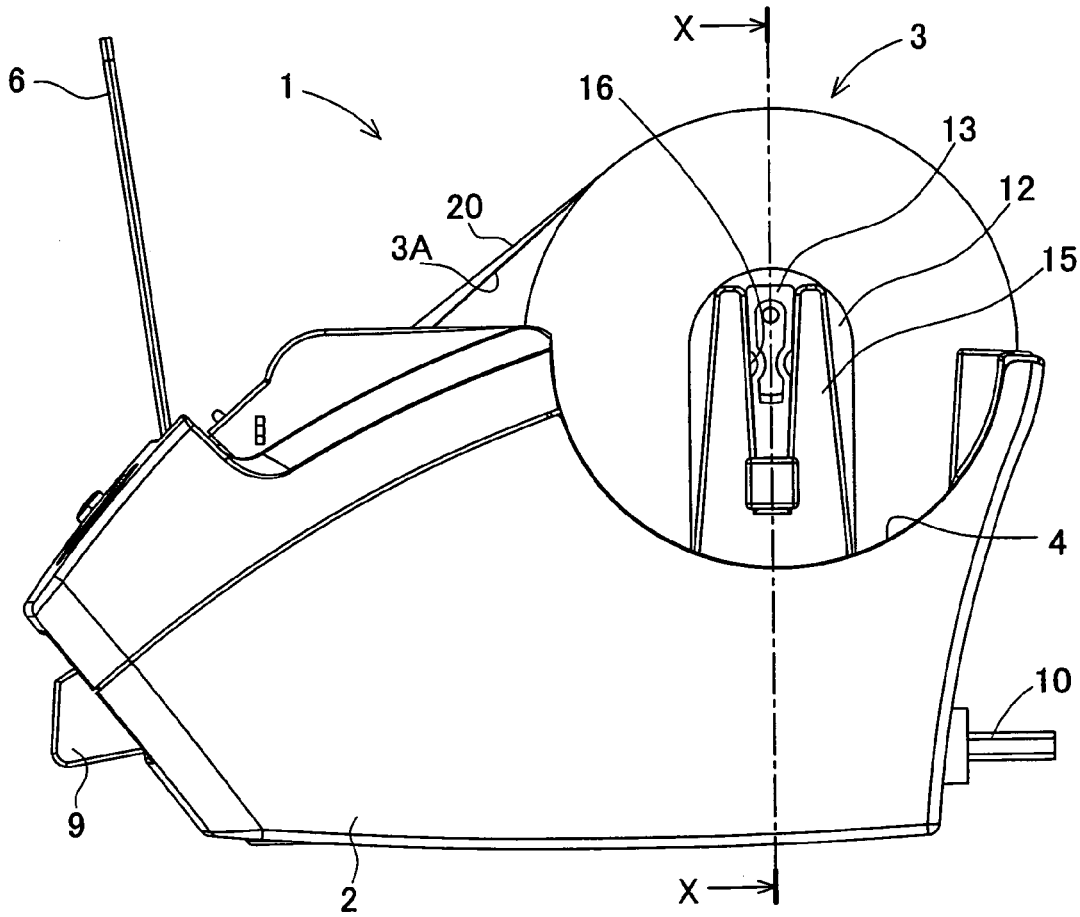
FIG. 3 is a side view of the tape printer of FIG. 2.
Figure 4:
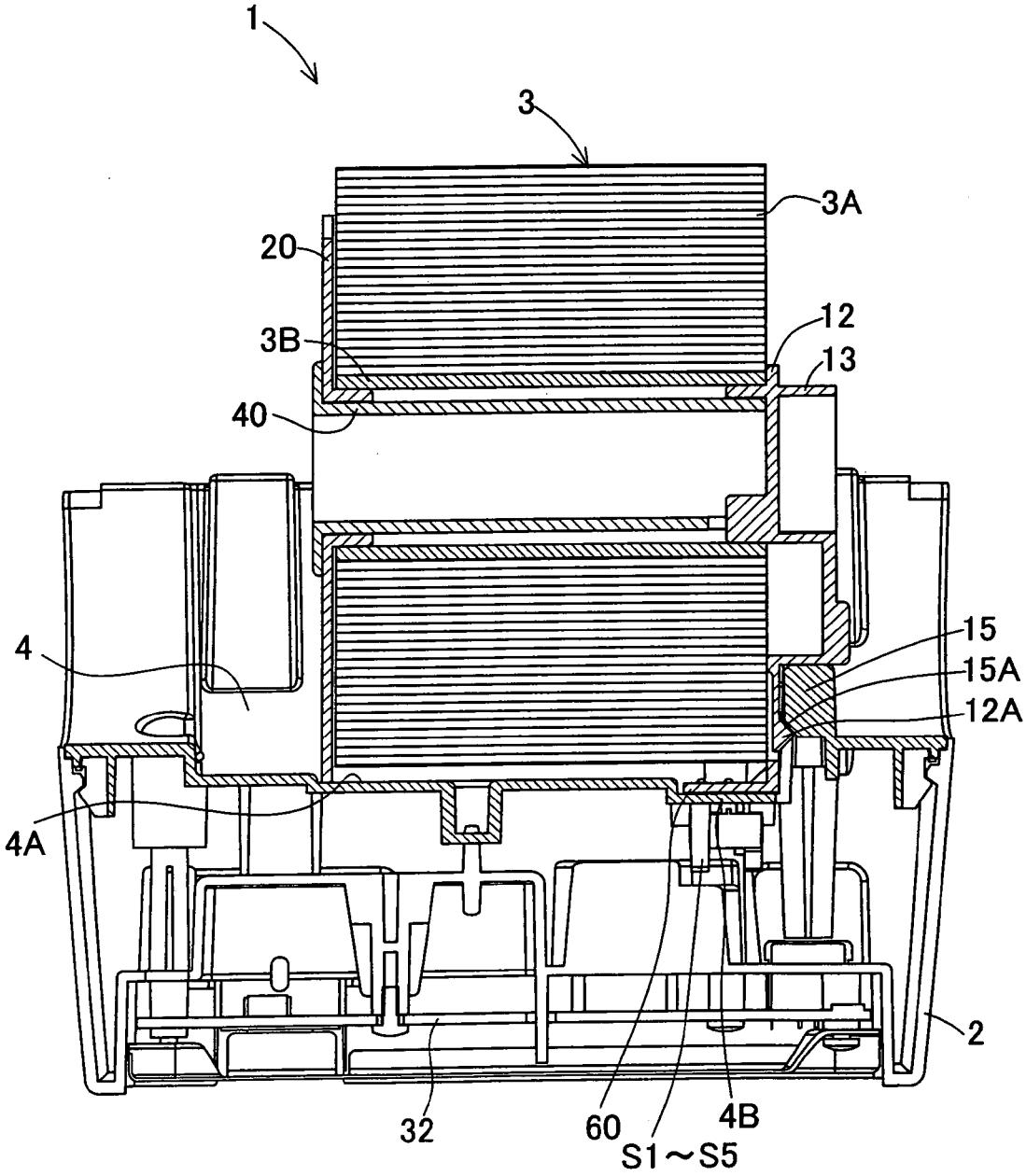
FIG. 4 is a sectional view taken along a line X—X in FIG. 3.
Figure 5A:
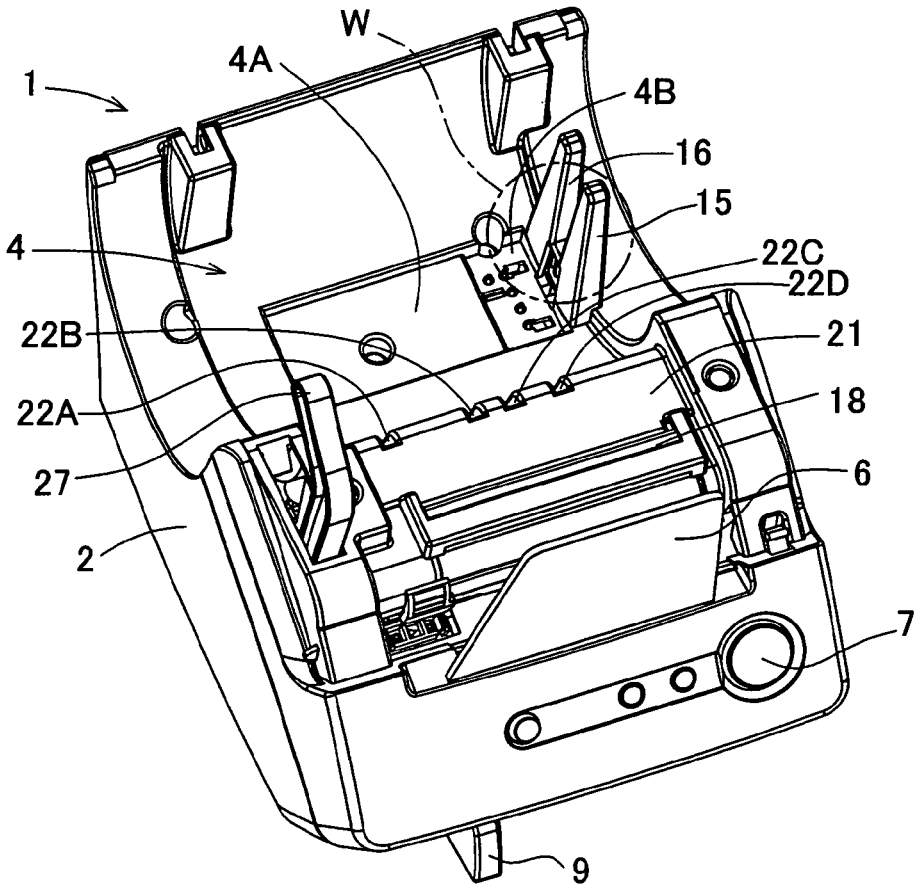
FIG. 5A is a schematic perspective view of the tape printer in the first embodiment, from which the top cover is removed.
Figure 5B:
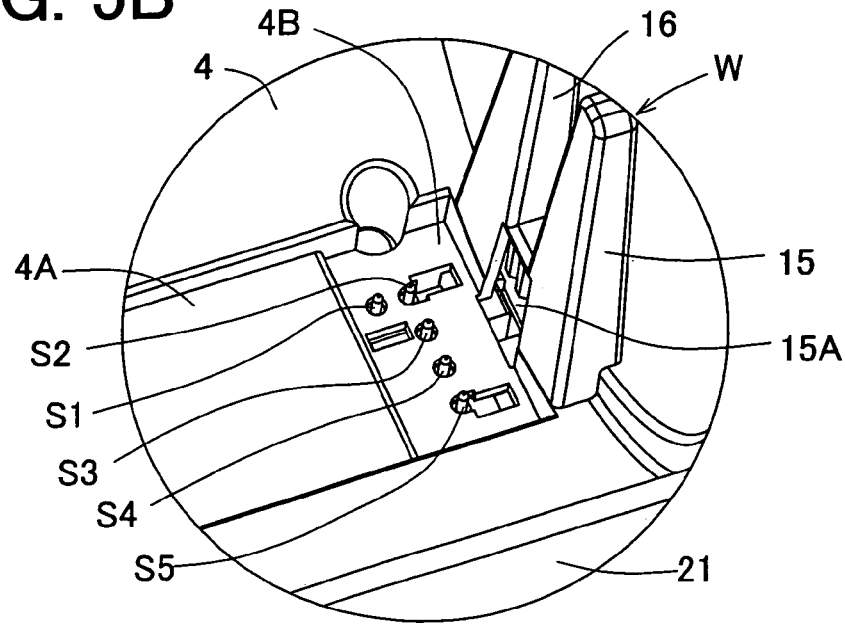
FIG. 5B is an enlarged perspective view of a portion indicated by a dashed circle W in FIG. 5A.
Figure 6:
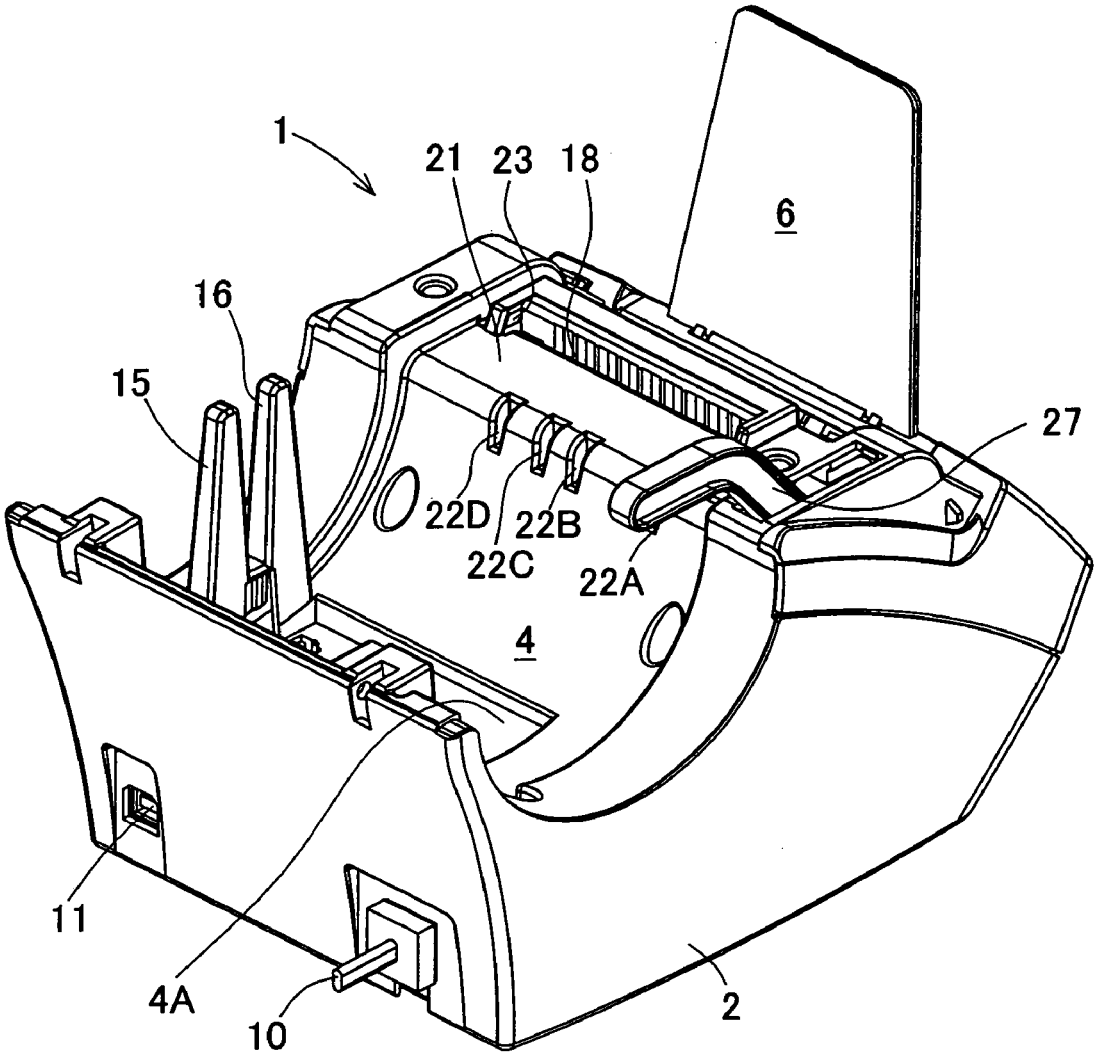
FIG. 6 is a schematic perspective back view of the tape printer in the first embodiment, from which the top cover is removed.

As shown in FIGS. 1 to 3, the tape printer 1 includes a housing 2, a top cover 5 made of transparent resin attached to the housing 2 at a rear upper edge, a tray 6 made of transparent resin set in a vertical position to face a substantially front center of the top cover 5, a power button 7 placed in front of the tray 6, a cutter lever 9 provided in a front face of the housing 2, and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width (see FIG. 14). The cutter lever 9 is movable side to side to horizontally move a cutter unit 8 (see FIG. 7). A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The roll sheet 3A is formed of a long thermal sheet (so-called "thermal paper") having a self color development property or a long label sheet formed of the thermal sheet whose one surface is bonded with a release sheet by adhesive. The roll sheet 3A is in a wound state around a hollow cylindrical sheet core 3B (see FIG. 4).

As shown in FIGS. 2 through 6, the tape printer 1 is provided with a holder support member 15 in the holder storage part 4 at a side end (a left side end in FIG. 6) in a substantially perpendicular direction to a sheet feeding direction. The holder support member 15 receives a mounting piece (a positioning rib) 13 of a positioning holding member (hereinafter, a "holding member") 12 constructing the roll sheet holder 3 mentioned later. The mounting piece 13 is provided protruding in a substantially longitudinal rectangular shape on the outer surface of the holding member 12. Specifically, the holder support member 15 is shaped like an angled U-shape as seen in side view of the printer 1, providing a first positioning groove 16 which opens upward in the tape printer 1 and toward both side surfaces of the holder support member 15 in a direction of the width of the tape printer. The holder support member 15 is also formed with a recess 15A which engages an elastic locking piece 12A formed projecting at a lower end of the holding member 12.

Figure 7:
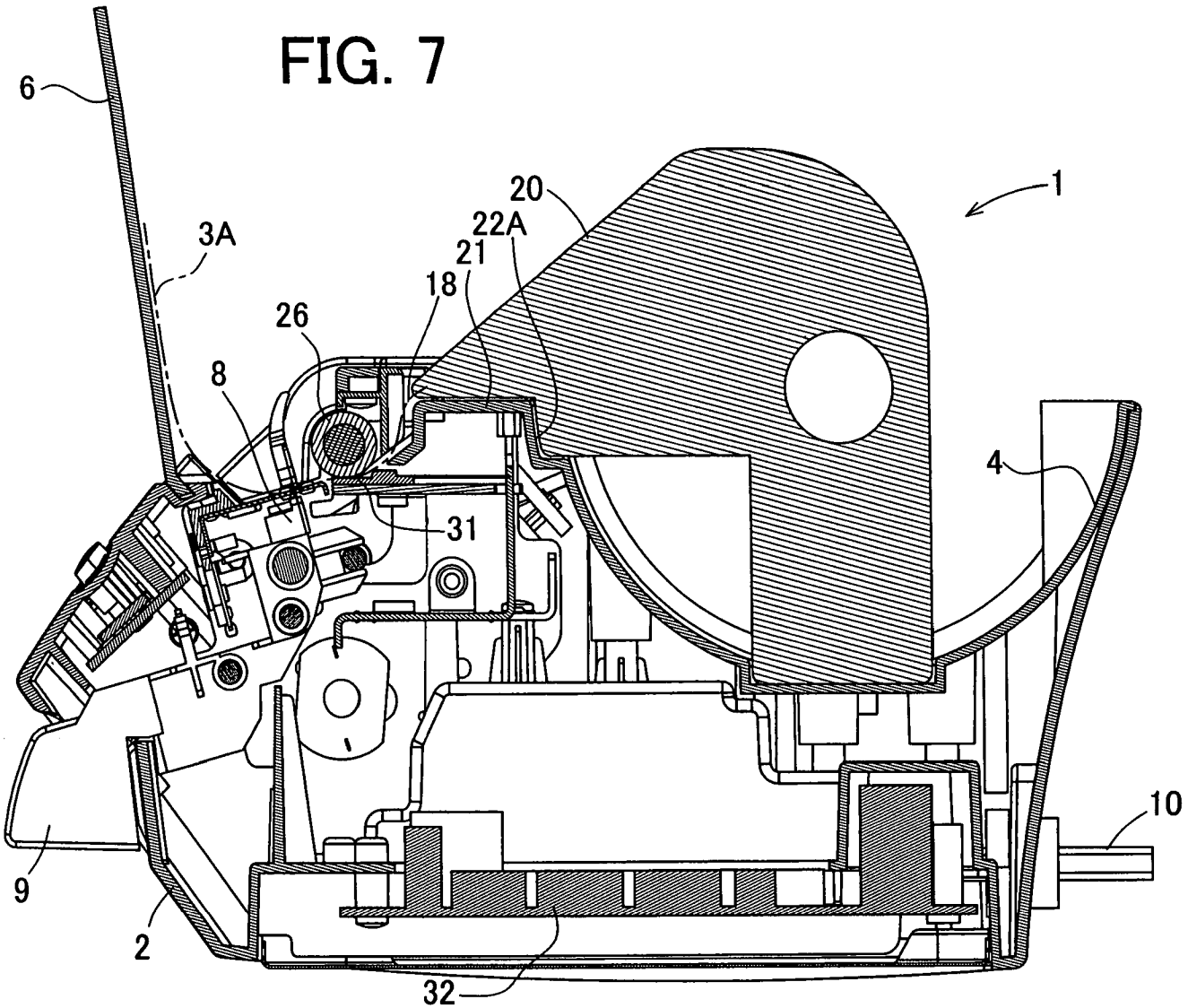
FIG. 7 is a sectional side view of the tape printer in the first embodiment, from which the top cover is removed.

The housing 2 is formed with an insertion opening 18 through which a leading end of an unwound part of the roll sheet 3A is inserted into the housing 2. A flat portion 21 is formed substantially horizontal between a rear end (in the feeding direction) of the slot 18 and a front upper edge portion of the holder storage part 4. On this flat portion 21, a front end portion of a guide member 20 of the roll sheet holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of roll sheets 3A of different widths. Each of the second positioning grooves 22A to 22D is configured to fittingly receive a front part of the guide member 20 inserted from above, as shown in FIG. 7. Further, the front end of the guide member 20 of the roll sheet holder 3 extends to the insertion opening 18.

Figure 8A:
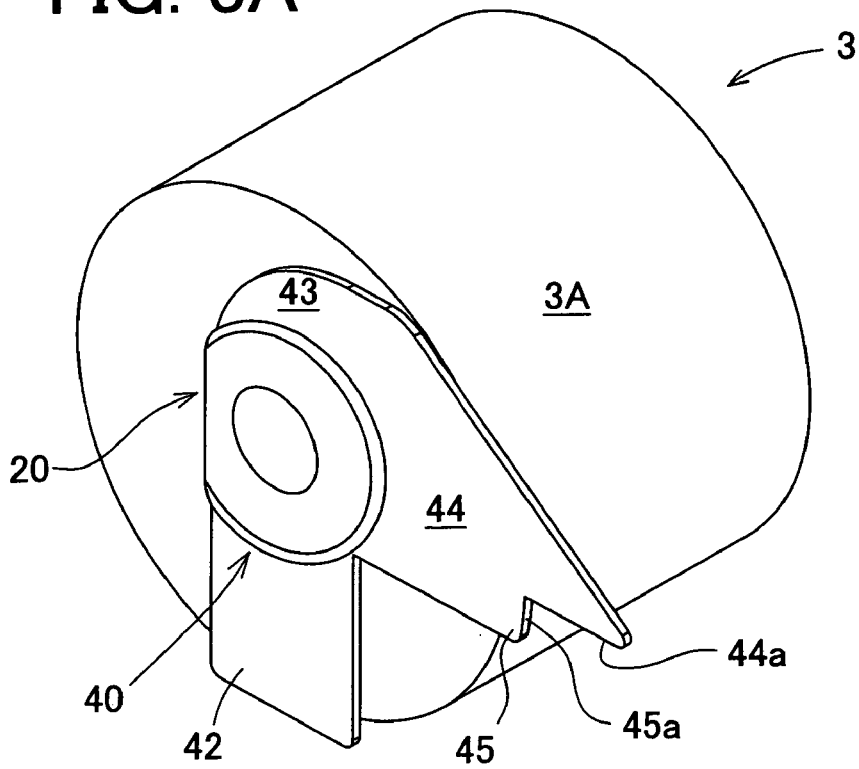
FIG. 8A is a perspective view of a roll sheet holder holding a roll sheet, seen from an obliquely front direction.
Figure 8B:
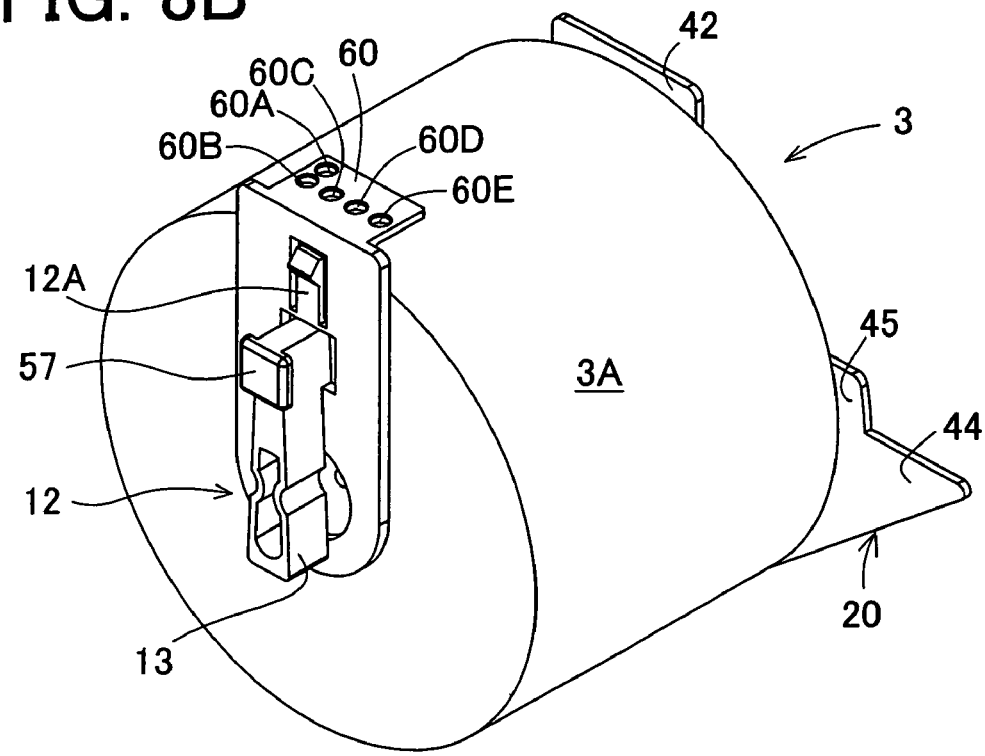
FIG. 8B is a perspective view of the roll sheet holder turned upside down, seen from an obliquely front direction.
Figure 9B:
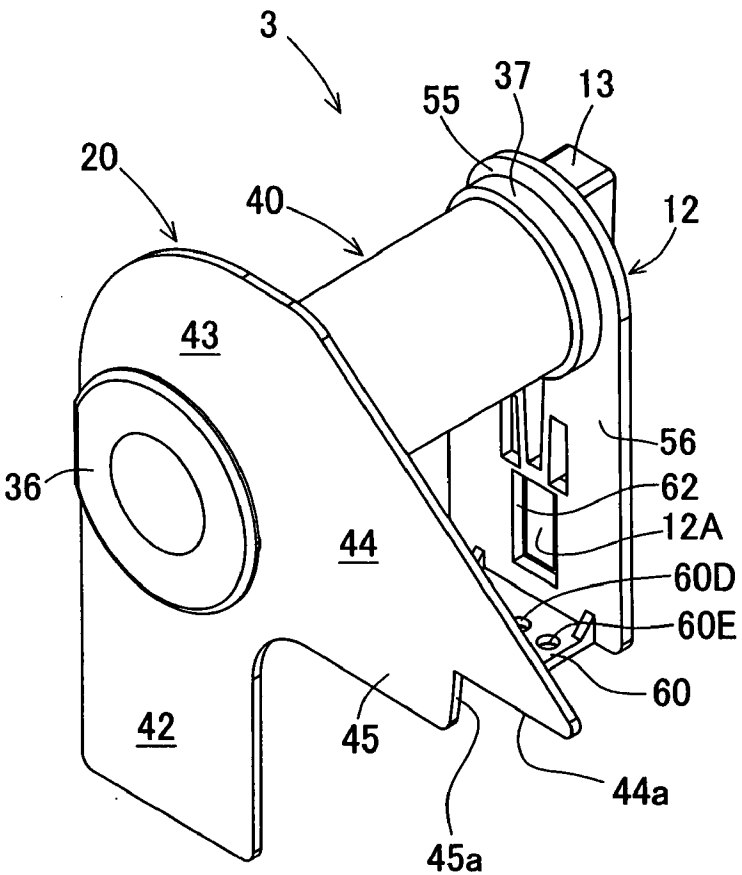
FIG. 9B is a perspective view of the roll sheet holder alone seen from an obliquely front direction.
Figure 9A:
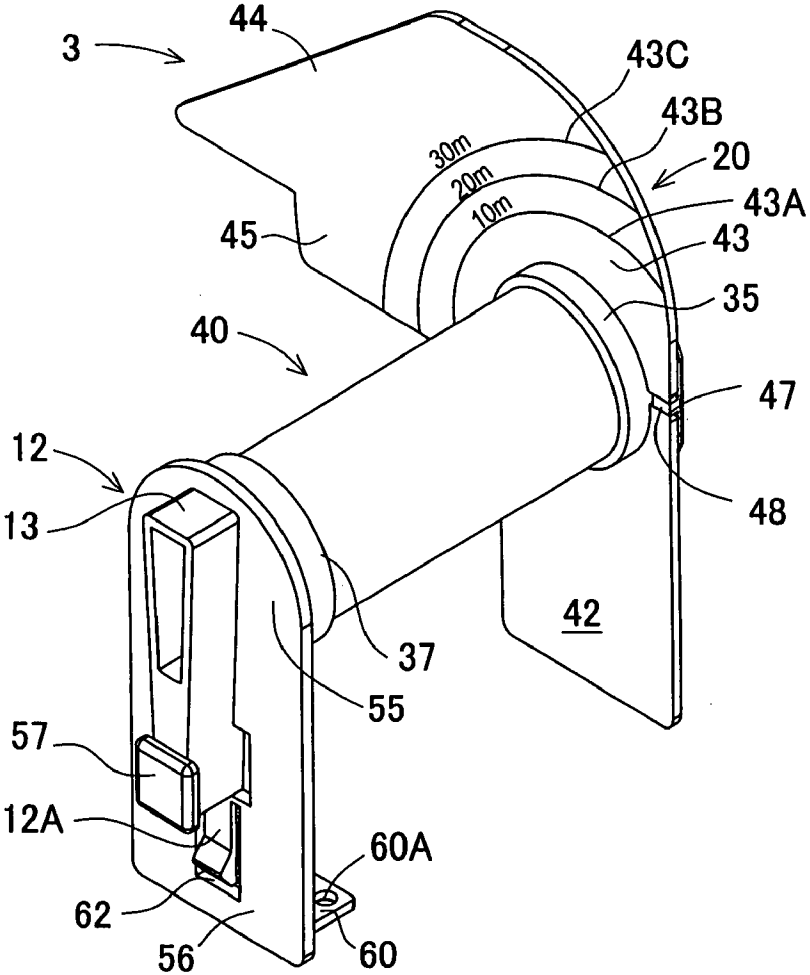
FIG. 9A is a perspective view of the roll sheet holder alone seen from an obliquely back direction.
Figures 10A, 10B, 10C:
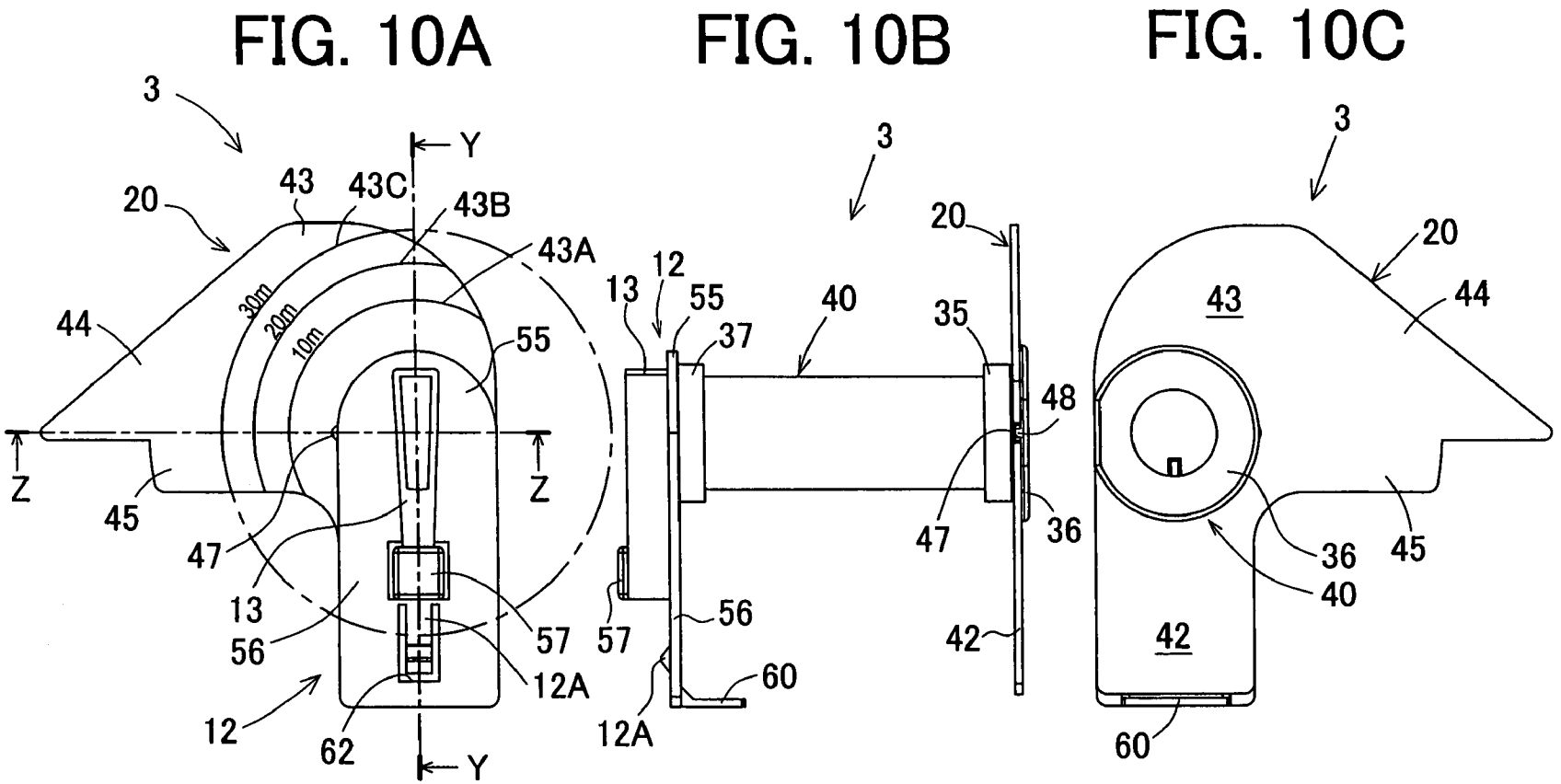
FIG. 10A is a side view of the roll sheet holder in the first embodiment, seen from left of the roll sheet holder in FIG. 10B.
FIG. 10B is a back view of the roll sheet holder in the first embodiment.
FIG. 10C is a side view of the roll sheet holder in the first embodiment, seen from right of the roll sheet holder in FIG. 10B.
Figure 11:
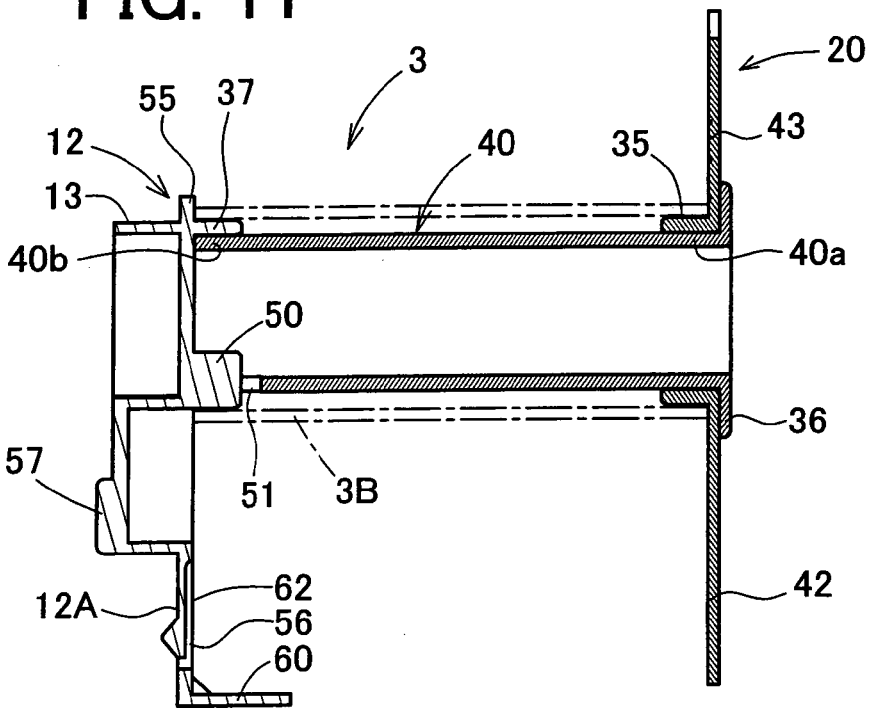
FIG. 11 is a sectional view of the roll sheet holder taken along a line Y—Y in FIG. 10A.
Figure 12:
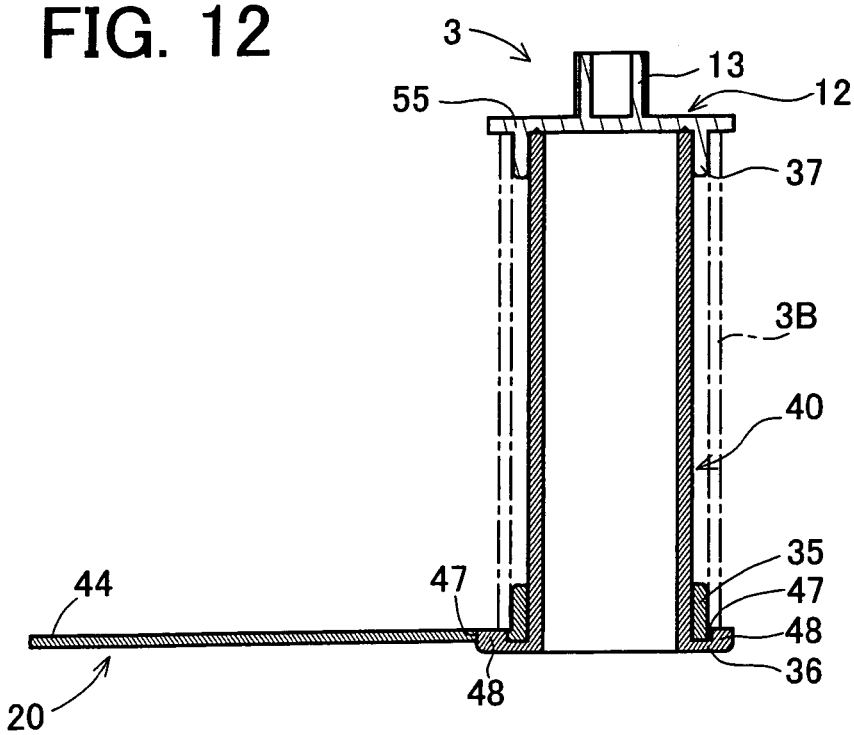
FIG. 12 is a sectional view of the roll sheet holder taken along a line Z—Z in FIG. 10A.
Figures 13A, 13B, 13C, 13D, 13E, 13F:
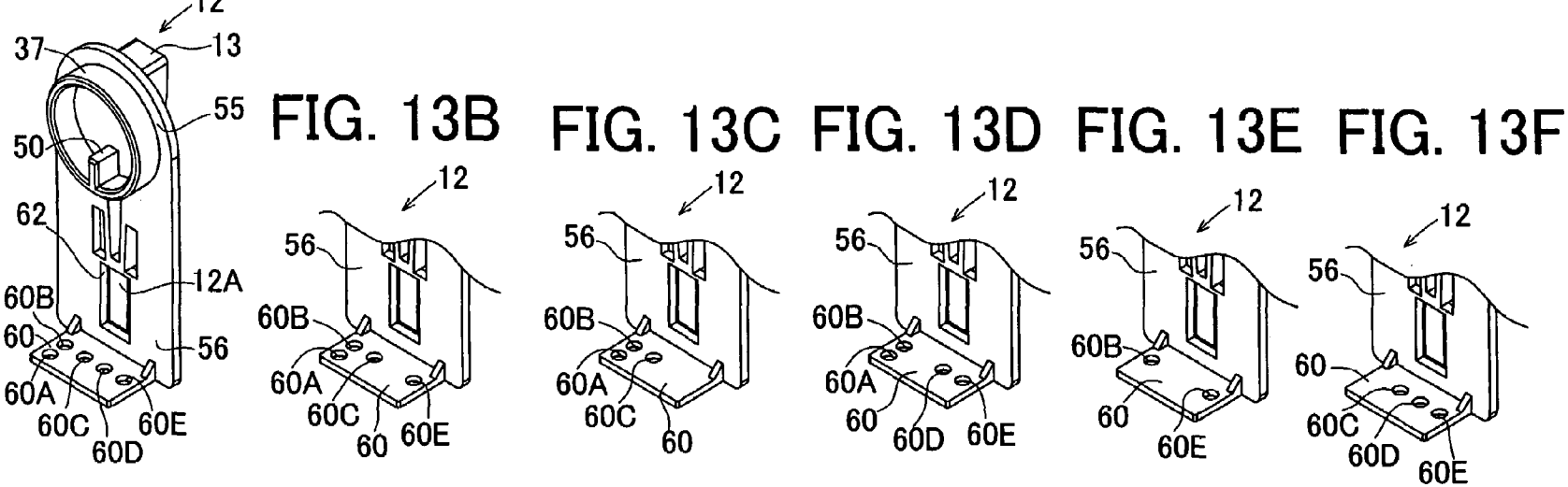
FIGS. 13A to 13F are partial views showing arrangement examples of sensor holes indicating the kinds of roll sheets, the holes being provided in a sheet discrimination part of a positioning holding member constructing a roll sheet holder in the first embodiment.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the first embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the first embodiment) than the positioning recess 4A. The discrimination recess 4B will receive a sheet discrimination part 60 (see FIGS. 8 to 10) mentioned later which extends inward from the lower end of the holding member 12 at a right angle therewith.

In the discrimination recess 4B, there are provided five sheet discrimination sensors S1, S2, S3, S4, and S5 arranged in an L-shaped pattern for distinguishing the kind (e.g., width) of the roll sheet 3A. These sensors S1 to S5 are each constructed of a push type microswitch or the like, specifically, a well known mechanical switch including a plunger and a microswitch. Each plunger is placed so that an upper end thereof protrudes from the bottom surface of the discrimination recess 4B to near the bottom surface of the positioning recess 4A.

It is detected whether the sheet discrimination part 60 has sensor holes (through holes) 60A to 60E (see FIG. 8B), mentioned later, at the positions corresponding to the sheet discrimination sensors S1 to S5 respectively. Based on an ON/OFF signal representing a detection result by the sensors S1 to S5, the kind of the roll sheet 3A held in the roll sheet holder 3 is detected. In the first embodiment, the tape discrimination sensors S1 to S5 are allowed to normally protrude from the bottom surface of the discrimination recess 4B to near the bottom surface of the positioning recess 4A, that is, at the height substantially corresponding to a depth difference between the discrimination recess 4B and the positioning recess 4A. At this time, each microswitch is in an OFF state.

In the case where the sheet discrimination part 60 has some sensor hole(s) 60A to 60E at the positions corresponding to the sheet discrimination sensors S1 to S5, the plunger(s) of the sensor(s) for which the sheet discrimination part 60 has sensor hole(s) is allowed to pass through the associated sensor holes 60A to 60E without depression, leaving the corresponding microswitch(es) in the OFF state, which generates an OFF signal.

On the other hand, the plunger(s) of the sensor(s) for which the sheet discrimination part 60 has no sensor hole(s) is depressed, bringing the corresponding microswitch(es) into the ON state, which generates an ON signal.

The insertion opening 18 is arranged so that its one side end (a left end in FIG. 6) on the holder support member 15 side in the tape printer 1 is positioned substantially in one plane with the inner surface of the holder support member 15 in which the positioning groove 16 opens, more properly, in one plane with the inner surface of the positioning member 12 when engaged in the holder support member 15. In the insertion opening 18, a guide rib 23 is formed on the side end near the holder support member 15.

A lever 27 for operating the vertical movement of a thermal head (see FIG. 7) is provided in front of the other side end (a left end in FIG. 5) of the holder storage part 4 in the feeding direction. To be more specific, when the lever 27 is turned up, the thermal head 31 is moved down and separated from a platen roller 26 (see FIG. 7). When the lever 27 is turned down, to the contrary, the thermal head 31 is moved up, thereby pressing the unwound part of the roll sheet 3A against the platen roller 26. A printable condition is thus developed. Further, below the roll sheet holder 4, there is provided a control board 32 on which a control circuit is formed to drivingly control each mechanism in response to commands from an external personal computer and others.

The roll sheet holder 3 in which the roll sheet 3A wound on the sheet core 3B is removably set in the holder storage part 4 in the following manner. The mounting piece 13 of the positioning member 12 is inserted from above into the first positioning groove 16 of the holder support member 15. The elastic locking piece 12A formed projecting at the lower end of the positioning member 12 is then engaged in the locking recess 15A formed in the inner base end of the holder support member 15. A front lower portion (i.e., a fourth extended portion 45 mentioned later) of the guide member 20 is engaged in appropriate one of the second positioning grooves 22A to 22D and the lower end portion of the guide member 20 is fittingly inserted in the positioning recess 4A. The sheet discrimination part 60 extending inward from the lower end of the positioning member 12 is fitted in the discrimination recess 4B. In this state, it is detected whether or not the sheet discrimination part 60 has the sensor holes 60A to 60E corresponding to the sheet discrimination sensors S1 to S5 arranged in the discrimination recess 4B. Specifically, the kind of the roll sheet 3A held in the roll sheet holder 3 can be detected.

A user (operator) moves the lever 27 up and inserts a leading end of a unwound part of the roll sheet 3A into the insertion opening 18 while keeping one side edge of the unwound part of the roll sheet 3A in contact with the inner surface of the guide member 20 and the other side edge in contact with the guide rib 23 provided at the side end of the insertion opening 18. Thereafter, the user moves the lever 27 down. Printing is thus enabled.

As shown in FIG. 7, when the lever 27 is moved down, the part of the roll sheet 3A inserted in the insertion opening 18 is pressed against the platen roller 26 by means of the thermal head 31 of a line type. The platen roller 26 is driven to rotate by a step motor or the like not shown while the thermal head 31 is drivingly controlled to print image data on a print surface of the roll sheet 3A which is fed sequentially. The printed part of the roll sheet 3A discharged onto the tray 6 is cut by a cutter unit 8 when the user moves the cut lever 9 rightward.

A schematic structure of the roll sheet holder 3 is explained below with reference to FIGS. 8 through 13.

As shown in FIG. 8 through 13, the roll sheet holder 3 is constructed of the guide member 20, the holding member 12, and a holder shaft 40 of a substantially tube shape. The guide member 20 has a first cylindrical part 35 which is fitted in one open end of the sheet core 3B of the roll sheet 3A so that the guide member 20 is held in contact with one of the end faces of the roll sheet 3A. The holding member 12 has a second cylindrical part 37 which is fitted in the other open end of the sheet core 3B so that the holding member 12 is held in contact with the other end face of the roll sheet 3A. The holder shaft 40 has two open ends 40*a* and 40*b*; the one end 40*a* is fitted in the first cylindrical part 35 of the guide member 20 and formed with a radially extended flange part 36 fixed onto the outer surface of the guide member 20 and the other end 40*b* is fixedly fitted in the second cylindrical part 37 of the holding member 12. The holder shaft 40 may be selected from among a plurality of shafts of different lengths to easily provide many kinds of roll sheet holders 3 holding roll sheets 3A of different widths.

The guide member 20 further includes a first, second, third, and fourth extended portions 41, 42, 43, and 44. The first extended portion 42 is formed extending downward in a predetermined length from a lower periphery of an outer end face of the first cylindrical part 35. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the roll sheet 3A. The third extended portion 44 is formed continuously extending from the second extended portion 43 up to near the insertion opening 18 (see FIG. 6) and has an upper edge sloped downward to the front end. This third extended portion 44 further has a lower edge (44*a*) extending horizontally, which is held in contact with the flat portion 21 of the tape printer 1 so that one side edge of the unwound part of the roll sheet 3A is guided along the inner surfaces of the second and third extended portions 43 and 44 up to the insertion opening 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the placing portion 21, a front edge (45*a*) of the fourth extended portion 45 is inserted in appropriate one of the second placing grooves 22A to 22D corresponding to the sheet width of the roll sheet 3A set in the sheet holder 3 (see FIG. 7).

The guide member 20 is further formed with slits 47 of a substantially rectangular shape in side view of the guide member 20, at an upper end of the first extended portion 42, i.e., at diametrical opposed positions of the periphery of the outer end face of the first cylindrical part 35. In these slits 47, protrusions 48 formed on the inner surface of the flange part 36 of the holder shaft 40 are engaged for positioning. In the guide member 20, scales 43A, 43B, and 43C are provided in concentric circular lines on the inner surfaces of the extended portions 43, 44, and 45. These scales 43A to 43C indicate the winding lengths of the roll sheet 3A; 10 m, 20 m, and 30 m. In the present embodiment, the maximum winding length of the roll sheet 3A set in the roll sheet holder 3 is about 30 m.

The holder shaft 40 is provided with a slit 51 in the end portion fitted in the second cylindrical part 37 of the holding member 12. The slit 51 has a predetermined length along the long direction of the shaft 40 to engage a rib 50 formed protruding radially inward from the inner lower end of the second cylindrical part 37. Such engagement between the rib 50 of the holding member 12 and the slit 51 of the holder shaft 40 makes it possible to correctly position the holding member 12 and the guide member 20 with respect to each other through the holder shaft 40.

The first and second cylindrical parts 35 and 37 serve to rotatably support the sheet core 3B of the roll sheet 3A. The holder shaft 40 may be selected from among a plurality of shafts (four shafts in the first embodiment) of different lengths individually corresponding to the lengths of the sheet cores 3B (i.e., the widths of the roll sheets 3A).

The outer open end of the second cylindrical part 37 is closed by the positioning member 12. A flange 55 is formed around the second cylindrical part 37. An extended portion 56 is continuously formed under the flange 55. Respective inner surfaces of the flange 55 and the extended portion 56 are held in contact with the end face of the roll sheet 3A and the sheet core 3B. On the outer surfaces of the flange 55 and the extended portion 56, the longitudinal mounting piece (positioning rib) 13 is provided protruding outward, at substantially the center of the width of the positioning member 12 in the feeding direction (a lateral direction in FIG. 10A). This mounting piece 13 is of a substantially rectangular section and has a vertical length in a direction substantially perpendicular to the central axis of the holder shaft 40 and a width which becomes smaller in a downward direction so that the mounting piece 13 is fitted in the first positioning groove 16 having a narrower width (in the feeding direction) towards the bottom of the holder support member 15 in the tape printer 1. The protruding distance of the mounting piece 13 is determined to be almost equal to the width (in a direction of the width of the tape printer 1, perpendicular to the feeding direction) of the first positioning groove 16.

The mounting piece 13 of the positioning member 12 is provided, on the lower outer surface, with a guide portion 57 of a square flat plate (about 1.5 mm to 3.0 mm in thickness in the first embodiment) having a larger width than the lower portion of the mounting piece 13 by a predetermined amount (about 1.5 mm to 3.0 mm in the first embodiment) at each side of the lower portion. Accordingly, to mount the roll sheet holder 3 in the tape printer 1, the user inserts the mounting piece 13 from above into the first positioning groove 16 by bringing an inner surface of the guide portion 57 into sliding contact with the outer surface of the holder support member 15. Thus, the roll sheet holder 3 can easily be fitted in place.

The positioning member 12 is designed to have the extended portion 56 extending downward longer by a predetermined length (about 1.0 mm to 2.5 mm in the first embodiment) than the lower end (the first extended portion 42) of the guide member 20. The positioning member 12 is also provided, at the lower end of the extended portion 56, with a sheet discrimination part 60 of a substantially rectangular shape extending inward by a predetermined length at almost right angle to the extended portion 56.

As shown in FIG. 8B and FIGS. 13A–13F, as mentioned above, the sheet discrimination part 60 is formed with the sensor holes 60A to 60E arranged at predetermined positions corresponding to the sheet discrimination sensors S1 to S5 respectively, in an L-shaped pattern in the present embodiment. The kind of roll sheet 3A held in the sheet holder 3 is represented by the number and an arrangement pattern of the sensor holes (see FIG. 13A to 13F). In the present embodiment, the number of the sensor holes is five at the maximum. Specifically, the presence and absence of each hole are allocated "1" and "0" respectively so that the kind of roll sheet 3A held in the roll sheet holder 3 is represented as five bits.

The positioning member 12 is further formed with a longitudinally rectangular through hole 62 in the extended portion 56 under the mounting piece 13. The elastic locking piece 12A is provided extending downward from the upper edge of the through hole 62 and formed with an outward protrusion at a lower end.

Figure 14B:
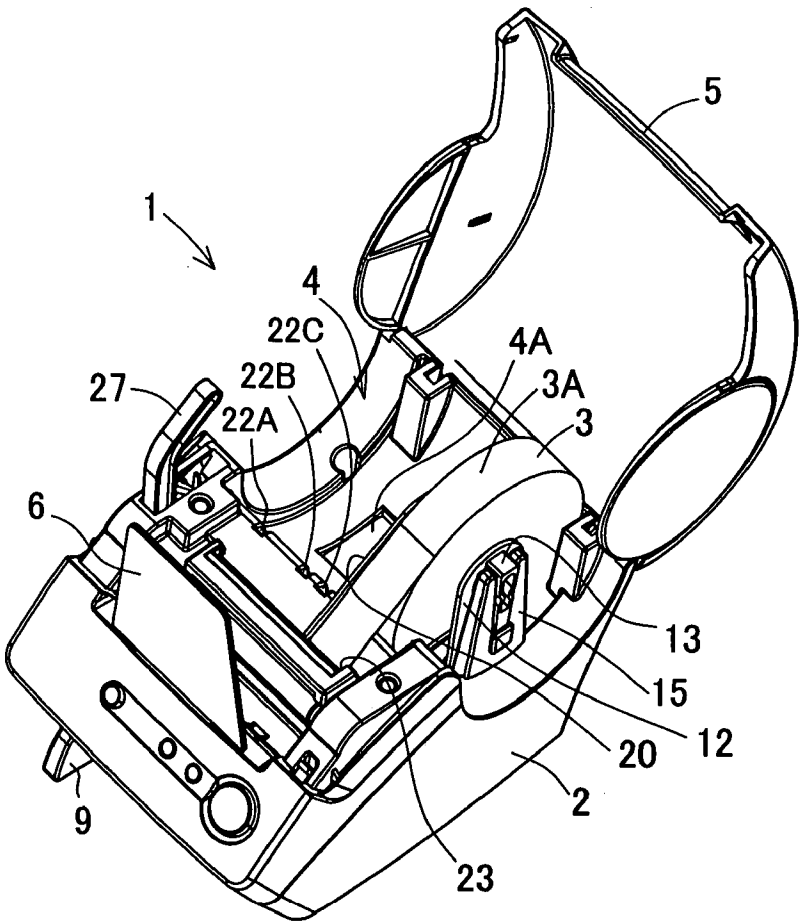
FIG. 14B is a perspective view of the tape printer in the first embodiment, in which the roll sheet holder for a minimum roll sheet width is mounted.
Figure 14A:
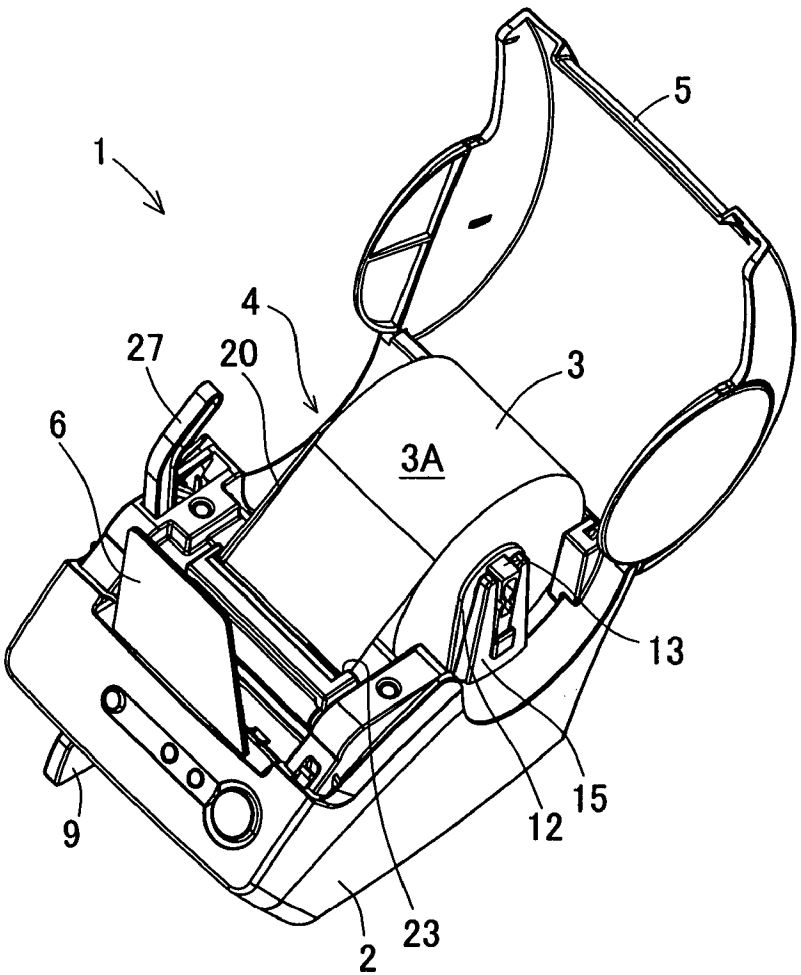
FIG. 14A is a perspective view of the tape printer in the first embodiment, in which the roll sheet holder for a maximum roll sheet width is mounted.

An explanation is given to a mounting manner of the roll sheet holder 3 constructed as above in the tape printer 1, referring to FIGS. 14A and 14B.

FIG. 14A shows the case where the roll sheet 3A holds a roll sheet 3A of a maximum width wound on a hollow cylindrical sheet core 3B. The mounting piece 13 of the holding member 12 of the holder 3 is first inserted from above into the positioning groove 16 of the holder support member 15. The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom. Detection as to whether the sensor holes 60A to 60E of the sheet discrimination part 60 is present/absent is enabled through the sheet distinctive sensors S1 to S5 individually.

Subsequently, the user turns the lever 27 upward and then draws (unwinds) part of the roll sheet 3A and inserts the leading end of the unwound part of the roll sheet 3A in the insertion opening 18 while guiding one side edge of the unwound part of the roll sheet 3A in contact with the inner surface of the guide member 20 and the other side edge in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

FIG. 14B shows the case where the roll sheet holder 3 holds a roll sheet 3A of a minimum width wound on a hollow cylindrical sheet core 3B. The mounting piece 13 of the holding member 12 of the holder 3 is first inserted from above into the positioning groove 16 of the holder support member 15. The sheet holder 3 is put so that the lower edge 44*a* of the third extended portion 44 of the guide member 20 is brought into contact with the flat portion 21. The fourth extended portion 45 is engaged in the second positioning groove 22D formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom. Detection as to whether the sensor holes 60A to 60E of the sheet discrimination part 60 is present/absent is enabled through the sheet distinctive sensors S1 to S5 individually.

Subsequently, the user turns the lever 27 up and then draws (unwinds) part of the roll sheet 3A to insert the leading end of the unwound part of the roll sheet 3A in the insertion opening 18 while guiding one side edge of the unwound part of the roll sheet 3A in contact with the inner surface of the guide member 20 and the other side edge in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

The above components in the present embodiment correspond to each element of the invention as below. The platen roller 26 serves as a feeding device. The platen roller 26 and the thermal head 31 in combination construct a printing device. The first, second, third, and fourth extended portions 42, 43, 44, and 45 construct a first flange part. The second cylindrical part 37 serves as a second cylindrical part. The positioning holding member 12 serves as a positioning holding member whereby the roll sheet holder 3 is positioned in place in the tape printer 1. The flange part 36 serves as a second flange part. The mounting piece 13 serves as a positioning rib. The sensor holes 60A–60E construct a roll sheet identifying part. The holder support member 15 and the locking recess 15A construct a support mechanism. Further, the holder support member 15 serves as a positioning support member. The discrimination recess 4B serves as a recess.

In the tape printer 1 in the first embodiment, as described above, the sheet discrimination sensors S1 to S5 are provided near the base end of the holder support member 15 and serve in cooperation with the sensor holes 60A to 60E of the sheet discrimination part 60 to identify the kind of the roll sheet 3A. When the mounting piece 13 is inserted into the first positioning groove 16 of the holder support member 15, accordingly, the sensor holes 60A to 60E of the sheet discrimination part 60 can be positioned in place. The detection precision of each sensor S1 to S5 can be enhanced.

The discrimination recess 4B is formed in the inside bottom of the holder storage part 4 as mentioned above. The holder 3 is put from above into the holder storage part 4 and also the sheet discrimination part 60 is fitted from above in the discrimination recess 4B. Thus, the sensor holes 60A to 60E can easily be positioned in place. This makes it possible to surely enable operation of each sheet discrimination sensor S1 to S5, thereby improving the reliability of the sensors S1 to S5.

The mounting piece 13 provided protruding from the outer surface of the holding member 12 of the roll sheet holder 3 is positioned and slid into the first positioning groove 16 which opens upward in the tape printer 1. Then, the kind of the roll sheet 3A is specified by means of the sensor holes 60A to 60E of the sheet discrimination part 60 having a predetermined length extending from the lower end of the holding member 12 to face the lower portion of the outer peripheral surface of the roll sheet 3A of the maximum diameter. The sheet discrimination part 60 with the sensor holes 60A to 60E can be placed vertically below the central axis of the roll sheet 3A. Accordingly, the sheet holder 3 can be held down by the own weight of the roll sheet 3A to fixedly dispose the sheet discrimination part 60 in place with respect to the sheet discrimination sensors S1 to S5, thereby preventing the sheet discrimination part 60 from coming off upward.

As mentioned above, the sheet discrimination part 60 is provided extending by a predetermined length from the lower end of the positioning member 12 to face the lower portion of the outer peripheral surface of the roll sheet 3A of the maximum diameter. Accordingly, even when a winding state of the roll sheet 3A slightly loosens due to an elastic restoring force of the roll sheet 3A, the lower portion of the outer peripheral surface of the roll sheet 3A is pressed against the sheet discrimination part 60. This makes it possible to surely prevent the roll sheet 3A from further loosening.

Moreover, while part of the roll sheet 3A is unwound (drawn), the sheet discrimination part 60 with the sensor holes 60A to 60E is held in place by the sensors S1 to S5 passing through the corresponding sensor holes 60A to 60E. It is therefore possible to prevent the sensor holes 60A to 60E from coming off the corresponding sensors S1 to S5 and to provide an improvement in print quality.

[Second Embodiment]

A second preferred embodiment of the roll sheet holder and the tape printer will be explained below with reference to FIGS. 15 and 16. Similar or identical elements of the roll sheet holder and the tape printer in the second embodiment to those in the first embodiment are indicated by the same reference numbers.

The schematic structures of the roll sheet holder and the tape printer in the second embodiment are substantially the same as those of the roll sheet holder 3 and the tape printer 1 in the first embodiment. In addition, various kinds of processing for controlling the tape printer are substantially the same as those in the first embodiment.

A different structure from the first embodiment is in that a positioning holding member of the roll sheet holder and a discrimination recess formed in a roll sheet holder storage part of the tape printer in the second embodiment differ from the holding member 12 of the roll sheet holder 3 and the discrimination recess 4B formed in the holder storage part 4 of the tape printer 1 in the first embodiment.

Figure 15:
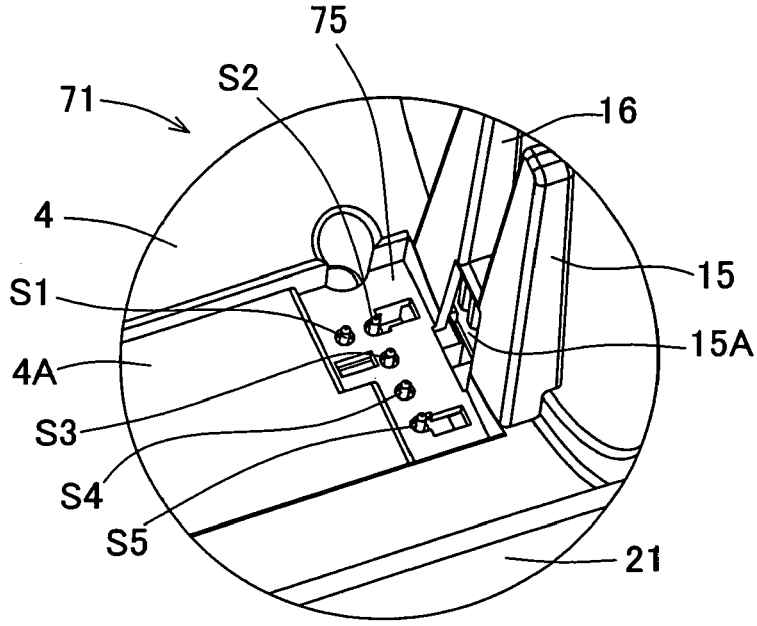
FIG. 15 is an enlarged perspective view of a tape printer in a second embodiment, showing a discrimination recess of a roll sheet holder storage part.

Referring to FIG. 15, an explanation will be given to the structure of the discrimination recess formed in the roll sheet holder storage part of the tape printer in the second embodiment.

As shown in FIG. 15, a recess 4A is formed in a bottom of a roll sheet holder storage part 4 in a tape printer 71 in the second embodiment. The recess 4A is rectangular in plan view and long sideways in a direction substantially perpendicular to the feeding direction, extending from an inner base end of the holder support member 15 to a position corresponding to the second positioning groove 22A. This recess 4A has a predetermined depth (about 1.5 mm to 3.0 mm in the second embodiment). The width of the positioning recess 4A in the feeding direction is determined to be almost equal to the width of each lower end portion of a positioning holding member (hereinafter, a "holding member") 72 (see FIG. 16) of the roll sheet holder 3 and the guide member 20. A discrimination recess 75 is provided between the positioning recess 4A and the inner base end of the holder support member 15. This discrimination recess 75 is rectangular in plan view, which is long in the feeding direction, and has a depth larger by a predetermined distance (about 1.5 mm to 3.0 mm in the second embodiment) than the positioning recess 4A. The discrimination recess 75 will receive a sheet discrimination part 73 (see FIG. 16) mentioned later which extends inward from the lower end of the holding member 72 at a right angle thereto.

The discrimination recess 75 is shaped to be smaller in width in a front part (a lower part in FIG. 15) in the feeding direction from substantially the center between sheet discrimination sensors S3 and S4 so that the boundary between the discrimination recess 75 and the positioning recess 4A is substantially aligned with sheet discrimination sensor S1, that is, the positioning recess 4A is partially extended inside the discrimination recess 75 (rightward in FIG. 15).

In this discrimination recess 75, there are provided five sheet discrimination sensors S1, S2, S3, S4, and S5 arranged in an L-shaped pattern for distinguishing the kind of the roll sheet 3A. These sensors S1 to S5 are each constructed of a push type microswitch or the like, specifically, a well known mechanical switch including a plunger and a microswitch. Each plunger is placed so that an upper end thereof protrude from the bottom surface of the discrimination recess 75 to near the bottom surface of the positioning recess 4A.

It is detected whether the sheet discrimination part 73 has sensor holes 73A to 73E (see FIG. 16), mentioned later, at the positions corresponding to the sheet discrimination sensors S1 to S5 respectively. Based on an ON/OFF signal representing a detection result through the sensors S1 to S5, the kind of the roll sheet 3A held in the roll sheet holder 3 is detected. In the second embodiment, the tape discrimination sensors S1 to S5 are allowed to normally protrude from the bottom surface of the discrimination recess 75 to near the bottom surface of the positioning recess 4A, that is, at the height corresponding to a depth difference between the discrimination recess 75 and the positioning recess 4A. At this time, each microswitch is in an OFF state. In the case where the sheet discrimination part 73 has the sensor holes 73A to 73E at the corresponding positions to the sheet discrimination sensors S1 to S5, respective plungers are allowed to pass through the corresponding sensor holes 73A to 73E without depression and respective microswitches are in the OFF state, each generating an OFF signal. In the case where the sheet discrimination part 73 have only one or some of the sensor holes 73A to 73E at the corresponding positions to the sheet discrimination sensors S1 to S5, the plunger(s) of the relevant sensor(s) for which the sheet discrimination part 60 has no sensor hole(s) is depressed, bringing the corresponding microswitch(es) into the ON state, which generates an ON signal.

Figure 16:
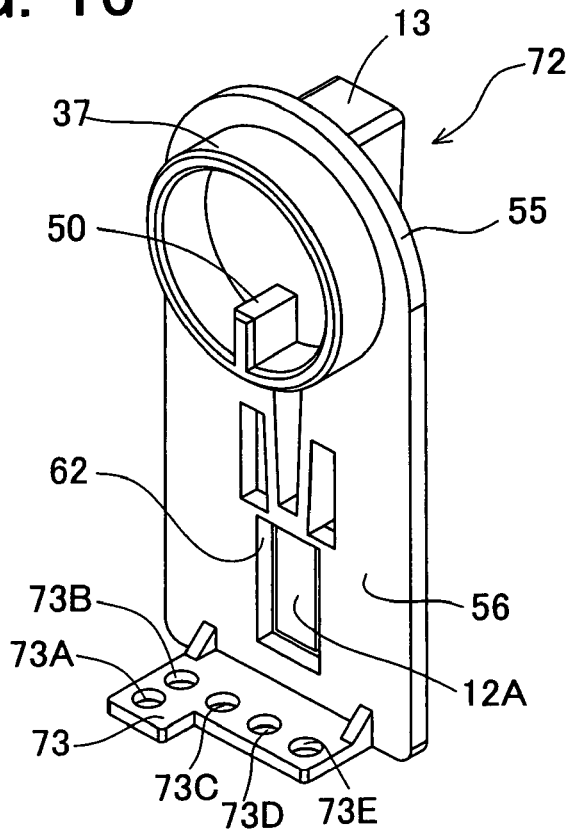
FIG. 16 is a perspective view of one example of a positioning holding member constructing the roll sheet holder in the second embodiment.

As shown in FIG. 16, the holding member 72 of the roll sheet holder 3 in the second embodiment has substantially the same structure as the holding member 12 in the first embodiment expect that the extended portion 56 of the holding member 72 is formed at a lower end with the sheet discrimination part 73 different from the sheet discrimination part 60. This sheet discrimination part 73 of the holding member 72 extends inward by a predetermined length from the lower end of the extended portion 56 and at almost right angle to the extended portion 56. The sheet discrimination part 73 has an extended portion of a predetermined length at a rear end in the feeding direction so that the sheet discrimination part 73 is of an almost L-shape in plan view.

In the sheet discrimination part 73, the sensor holes 73A and 73B are formed in line in the extended portion of the sheet discrimination part 73, i.e., in the rear end portion in the feeding direction, and the sensor holes 73B to 73E are formed in line along the feeding direction so that the sensor holes 73A to 73E are arranged at predetermined positions corresponding to the sheet discrimination sensors S1 to S5 respectively, showing an L-shaped pattern. In the present embodiment, the number of the sensor holes is five at the maximum. Specifically, the presence and absence of each hole are allocated "1" and "0" respectively so that the kind of the roll sheet 3A held in the roll sheet holder 3 be represented as five bits.

The sensor holes 73A to 73E construct a roll sheet identifying part. The holding member 72 serves as a positioning holding member. The discrimination recess 75 serves as a recess.

The tape printer 71 in the second embodiment, as described above, can provide the same effects as the tape printer 1 in the first embodiment and further can achieve a reduction in size of the sheet discrimination part 73 of the holding member 72, which results in reductions in materials of the roll sheet holder 3 and manufacturing cost.

[Third Embodiment]

A third preferred embodiment of the roll sheet holder and the tape printer will be explained below with reference to FIGS. 17 and 18. Similar or identical elements of the roll sheet holder and the tape printer in the third embodiment to those in the first embodiment are indicated by the same reference numbers.

The schematic structures of the roll sheet holder and the tape printer in the third embodiment are substantially the same as those of the roll sheet holder 3 and the tape printer 1 in the first embodiment. In addition, various kinds of processing for controlling the tape printer are substantially the same as those in the first embodiment.

A different structure from the first embodiment is in that a positioning holding member of the roll sheet holder and a discrimination recess formed in a roll sheet holder storage part of the tape printer in the third embodiment differ from the holding member 12 of the roll sheet holder 3 and the discrimination recess 4B formed in the holder storage part 4 of the tape printer 1 in the first embodiment.

Figure 17:
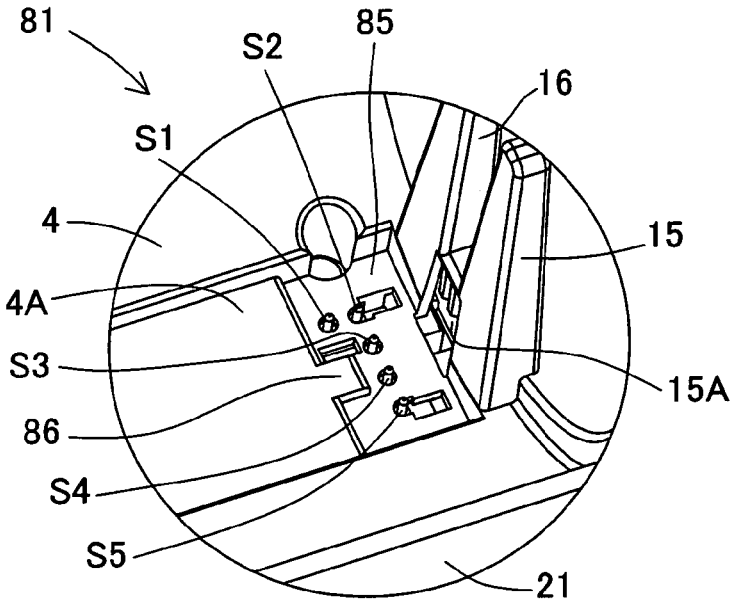
FIG. 17 is an enlarged perspective view of a tape printer in a third embodiment, showing a discrimination recess of a roll sheet holder storage part.

Referring to FIG. 17, an explanation will be given to the structure of the discrimination recess formed in the roll sheet holder storage part of the tape printer in the third embodiment.

As shown in FIG. 17, a recess 4A is formed in a bottom of a roll sheet holder storage part 4 in a tape printer 81 in the third embodiment. The recess 4A is rectangular in plane view and long sideways in a direction substantially perpendicular to the feeding direction, extending from an inner base end of the holder support member 15 to a position corresponding to the second positioning groove 22. This recess 4A has a predetermined depth (about 1.5 mm to 3.0 mm in the third embodiment). The width of the positioning recess 4A in the feeding direction is determined to be almost equal to the width of each lower end portion of a positioning holding member (hereinafter, a "holding member") 82 (see FIG. 18) of the roll sheet holder 3 and the guide member 20. A discrimination recess 85 is provided between the positioning recess 4A and the inner base end of the holder support member 15. This discrimination recess 85 is substantially rectangular in plan view, which is long in the feeding direction, and has a depth larger by a predetermined distance (about 1.5 mm to 3.0 mm in the third embodiment) than the positioning recess 4A. The discrimination recess 85 will receive a sheet discrimination part 83 (see FIG. 18) mentioned later which extends inward from the lower end of the holding member 82 at a right angle thereto.

The discrimination recess 85 is shaped to be smaller in width in substantially a center part in the feeding direction, corresponding to between the sheet discrimination sensors S3 and S4, so that the boundary between the discrimination recess 85 and the positioning recess 4A is substantially aligned with the sensor S1, that is, the positioning recess 4A is partially extended inside the discrimination recess 85 (rightward in FIG. 17), forming a positioning projection 86 whose edge is aligned with the sensor S1.

In this discrimination recess 85, there are five sheet discrimination sensors S1, S2, S3, S4, and S5 arranged in an L-shaped pattern for distinguishing the kind of the roll sheet 3A. These sensors S1 to S5 are each constructed of a push type microswitch or the like, specifically, a well known mechanical switch including a plunger and a microswitch. Each plunger is placed so that an upper end thereof protrude from the bottom surface of the discrimination recess 85 to near the bottom surface of the positioning recess 4A.

It is detected whether the sheet discrimination part 83 has sensor holes 83A to 83E (see FIG. 18), mentioned later, at the positions corresponding to the sheet discrimination sensors S1 to S5 respectively. Based on an ON/OFF signal representing a detection result through the sensors S1 to S5, the kind of the roll sheet 3A held in the roll sheet holder 3 is detected. In the third embodiment, the tape discrimination sensors S1 to S5 are allowed to normally protrude from the bottom surface of the discrimination recess 85 to near the bottom surface of the positioning recess 4A, that is, at the height corresponding to a depth difference between the discrimination recess 85 and the positioning recess 4A. At this time, each microswitch is in an OFF state. In the case where the sheet discrimination part 60 has the sensor holes 83A to 83E at the positions corresponding to the sheet discrimination sensors S1 to S5, respective plungers are allowed to pass through the corresponding sensor holes 83A to 83E without depression and respective microswitches are in the OFF state, each generating an OFF signal. In the case where the sheet discrimination part 83 have only one or some of the sensor holes 83A to 83E at the positions corresponding to the sheet discrimination sensors S1 to S5, the plunger(s) of the sensor(s) for which the sheet discrimination part 83 has no sensor hole(s) is depressed, bringing the corresponding microswitch(es) into the ON state, which generates an ON signal.

Figure 18:
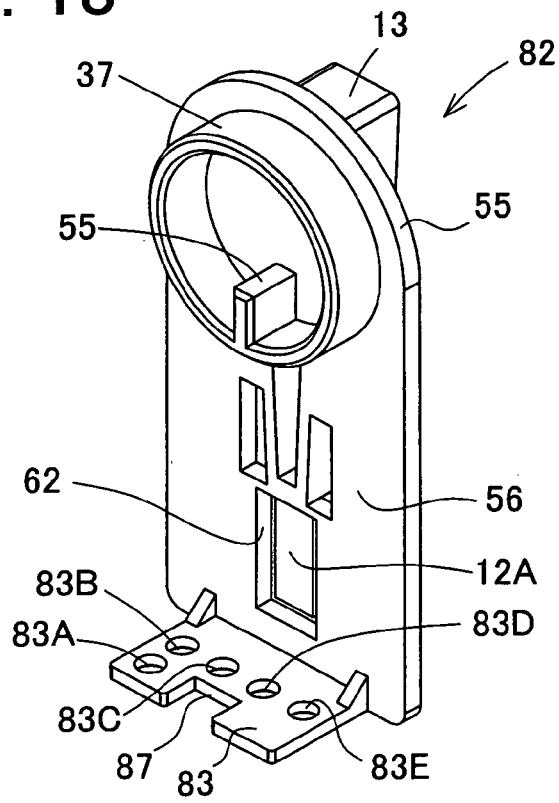
FIG. 18 is a perspective view of one example of a positioning holding member constructing the roll sheet holder in the third embodiment.

As shown in FIG. 18, the holding member 82 of the roll sheet holder 3 in the third embodiment has substantially the same structure as the holding member 12 in the first embodiment except that the extended portion 56 of the holding member 82 is formed at a lower end with the sheet discrimination part 83 different from the sheet discrimination part 60. This sheet discrimination part 83 of the holding member 82 extends inward by a predetermined length from the lower end of the extended portion 56 and at almost right angle to the extended portion 56. The sheet discrimination part 83 is shaped to have a cut-out (rightward in FIG. 18) in substantially a center part in the feeding direction, forming a positioning recess 87 having a length corresponding to between the sensor holes 83C and 83D and a width so that the edge of the positioning recess 87 is substantially aligned with the sensor hole 83A.

In this sheet discrimination part 83, the sensor holes 83A and 83B are formed in line in the rear end portion of the sheet discrimination part 83 in the feeding direction and the sensor holes 83B to 83E are formed in line along the feeding direction so that the sensor holes 83A to 83E are arranged at predetermined positions corresponding to the sheet discrimination sensors S1 to S5 respectively, showing an L-shaped pattern. In the present embodiment, the number of the sensor holes is five at the maximum. Specifically, the presence and absence of each hole are allocated "1" and "0" respectively so that the kind of the roll sheet 3A held in the roll sheet holder 3 be represented as five bits.

The sensor holes 83A to 83E construct a roll sheet identifying part. The holding member 82 serves as a positioning holding member. The discrimination recess 85 serves as a recess.

The tape printer 81 in the third embodiment, as described above, can provide the same effects as the tape printer 1 in the first embodiment. Since the positioning recess 87 of the sheet discrimination part 83 is engaged with the positioning projection 86 of the positioning recess 4A extended toward the holder support member 15, the holding member 82 can be prevented from wobbling at the lower end when the roll sheet holder 3 is set in the tape printer 1. The tape printer 1 in the present embodiment can provide an improved printing quality.

The present invention is not limited to the above mentioned first through third embodiments and may be embodied in other specific forms without departing from the essential characteristics thereof. For example, the following embodiments may be adopted.

[Fourth Embodiment]

In the above embodiments, the holding members 12, 72, and 82 each constructing the roll sheet holder 3 are provided with the sheet discrimination parts 60, 73, and 83 which extend inward and have the sensor holes 60A–60E, 73A–73E, and 83A–83E respectively which the sheet discrimination sensors S1–S5 are passed through. Instead thereof, the sheet discrimination parts 60, 73, and 83 may be provided, on the undersurface, with projections whereby the sensors S1–S5 are depressed according to the arrangement of the projections.

One example of such structure to depress the sensors S1 to S5 will be explained below in a fourth embodiment with reference to FIG. 19.

Similar or identical elements of the roll sheet holder and the tape printer in the fourth embodiment to the roll sheet holder 3 and the tape printer 1 in the first embodiment referring to FIGS. 1 through 14 are indicated by the same reference numerals.

Figure 19A:
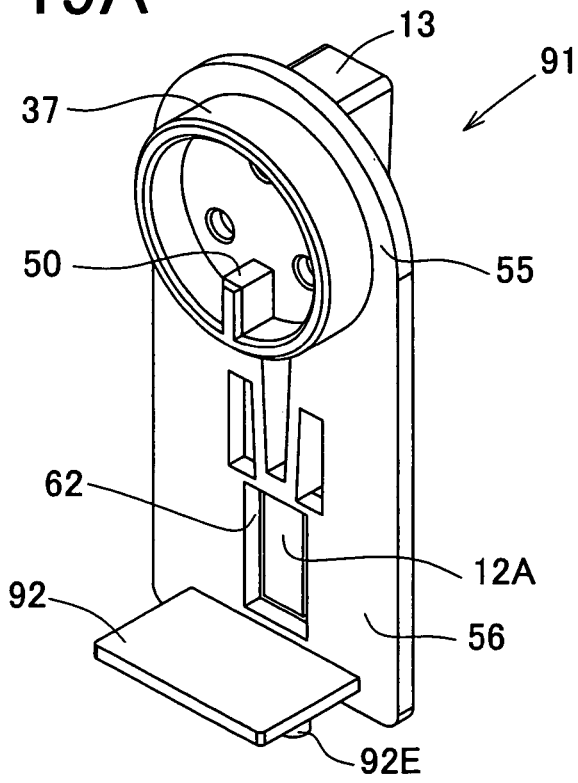
FIG. 19A is a perspective inside view of one example of a positioning holding member constructing a roll sheet holder in another embodiment.
Figure 19B:
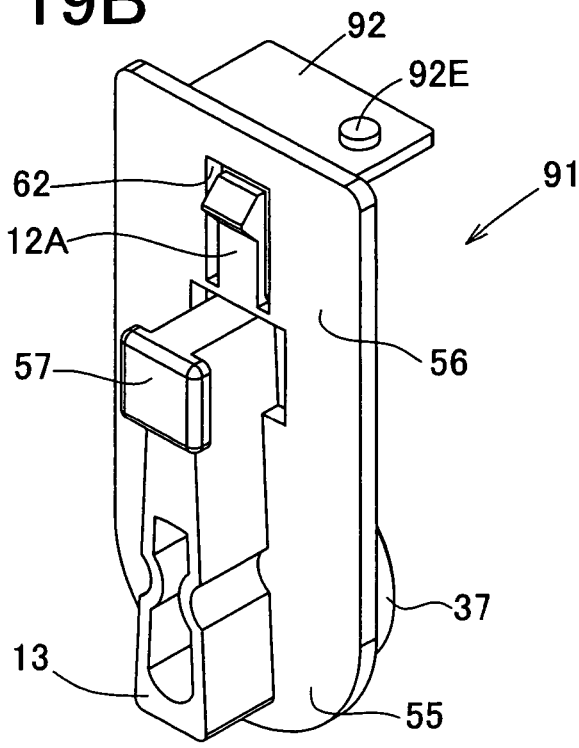
FIG. 19B is a perspective outside view of the positioning holding member placed upside down of FIG. 19A.

As shown in FIGS. 19A and 19B, a positioning holding member 91 is provided with a sheet discrimination part 92 having a similar shape to the above mentioned sheet discrimination part 60. To be more specific, the sheet discrimination part 92 is of a substantially rectangular shape extending inward by a predetermined length from a portion slightly above the lower end of an extended portion 56 of the holding member 91 at a predetermined height corresponding to the bottom surface of the positioning recess 4A. The sheet discrimination part 92 is formed, on the undersurface, with push bosses 92A to 92E protruding at the positions corresponding to the sheet discrimination sensors S1 to S5. It is to be noted that only a push boss 92E is provided in FIGS. 19A and 19B. These bosses 92A to 92E are formed to have a height (length) so that each lower surface be flush with the lower end surface of the extended portion 56.

If the sheet discrimination part 92 is provided with all of the push bosses 92A to 92E on the undersurface, it corresponds to each of the sheet discrimination parts 60, 73, and 83 that do not have any sensor holes 60A–60E, 73A–73E, and 83A–83E respectively. If the sheet discrimination part 92 is provided with only the push boss 92E as shown in FIGS. 19A and 19B, it corresponds to the sheet discrimination parts 60, 73, and 83 each having four sensor holes 60A–60D, 73A–73D, and 83A–83D respectively. If the sheet discrimination part 92 is not provided with any push bosses 92A–92E, it corresponds to the sheet discrimination parts 60, 73, and 83 each having five sensor holes 60A–60E, 73A–73E, and 83A–83E respectively.

[Fifth Embodiment]

Figure 20:
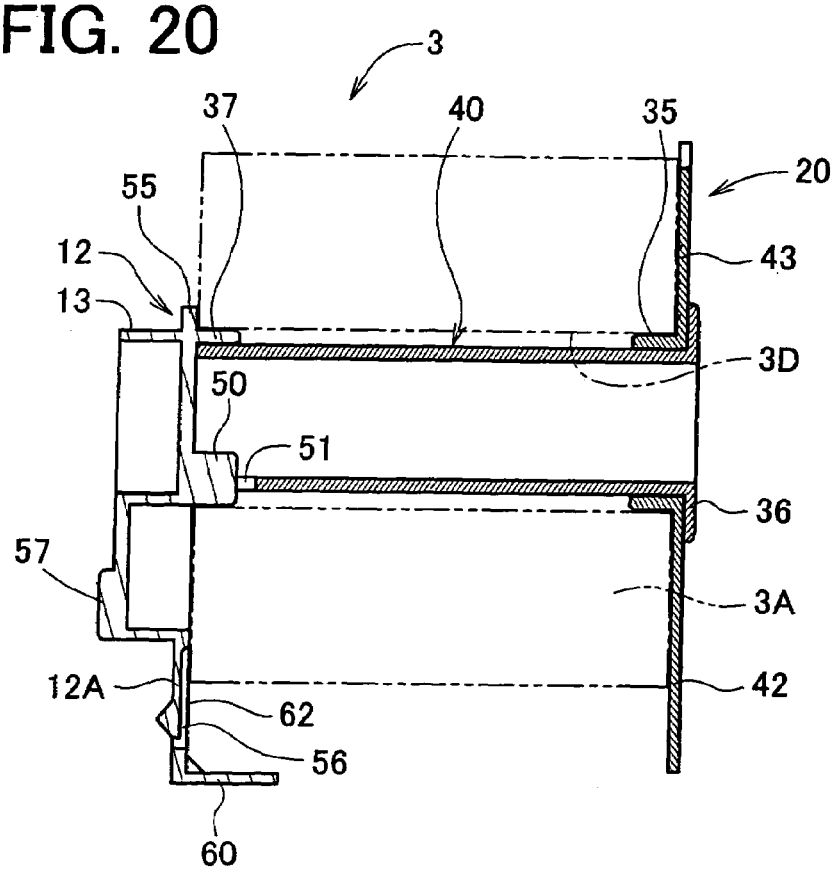
FIG. 20 is a schematic sectional view of the roll sheet holder of the tape printer in the first embodiment, taken along a line Y—Y in FIG. 10A, in which another roll sheet in a rolled state is set.
Figure 21:
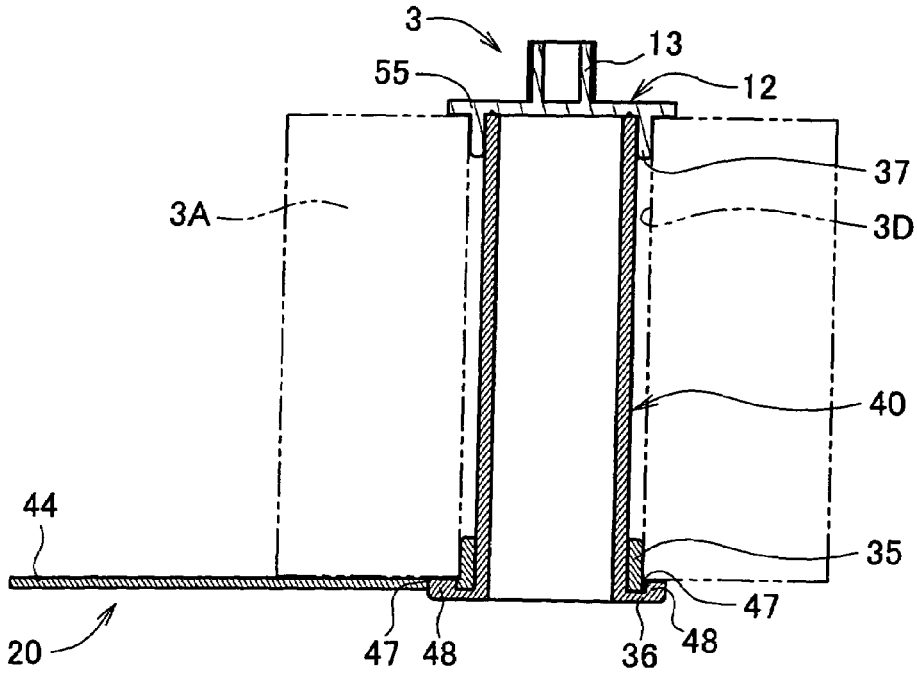
FIG. 21 is a schematic sectional view of the roll sheet holder of the tape printer in the first embodiment, taken along a line Z—Z in FIG. 10A, in which another roll sheet in a rolled state is set.

Each roll sheet holder 3 in the first, second, third, and fourth embodiments holds the roll sheet 3A would on the sheet core 3B. Alternatively, the roll sheet 3A may be rolled up by itself without the sheet core 3B as shown in FIGS. 20 and 21 so that a cylindrical through hole 3D is centrally formed having an inner diameter substantially equal to the outer diameters of the second cylindrical part 37 of the holding member 12 and the first cylindrical part 35 of the guide member 20. With this structure of the roll sheet 3A, eliminating the need for the sheet core 3B, the number of components or parts of the roll sheet holder 3 can be reduced. Further, the maximum length of the roll sheet 3A settable in the roll sheet holder 3 can be increased.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A roll sheet holder which holds a roll sheet wound on a cylindrical sheet core having a through hole opening at both ends and is removably mountable in a tape printer which includes a feeding device which draws the roll sheet to feed an unwound part thereof, a printing device which prints on the part of the roll sheet fed by the feeding device, the roll sheet holder comprising:

a guide member including a first cylindrical part which is formed with a cylindrical through hole and is fitted in one open end of the sheet core and a first flange part which is formed in an outer periphery of an outer end face of the first cylindrical part and is brought into contact with one end face of the roll sheet;

a positioning holding member which is arranged in contact with the other end face of the roll sheet and formed with a second cylindrical part on an inner surface, the second cylindrical part being fitted in the other open end of the sheet core;

a shaft including a first end which is fitted in the through hole of the first cylindrical part of the guide member and is provided with a second flange part fixed in contact with an outer surface of the first flange part and a second end which is fitted in the second cylindrical part to be fixed to the positioning holding member; wherein the roll sheet holder is mountable in the tape printer which includes an insertion opening in which the unwound part of the roll sheet is inserted and a support portion provided upstream of the insertion opening in a direction of feeding the unwound part of the roll sheet;

the first flange part includes:

a first extended portion extending downward in a predetermined length from a lower periphery of the outer end face of the first cylindrical part, the first extended portion being brought into contact with a bottom surface of the tape printer when the roll sheet holder is mounted therein; and a frontward extended portion formed extending downstream in a direction of drawing the roll sheet from the outer periphery of the outer end face of the first cylindrical part to have a front end which is located outside of an outermost surface of the roll sheet of a maximum diameter and have a lower edge which is brought into contact with an upper surface of the support portion when the roll sheet holder is mounted in the tape printer; and the roll sheet holder is arranged to unwind the roll sheet from above the sheet core and inserted in the insertion opening when the roll sheet holder is mounted in the tape printer.

2. The roll sheet holder according to claim 1, wherein the tape printer includes a first positioning groove which opens upward and at both sides in a direction of a width of the tape printer, one side of which being positioned substantially in one plane with one side end of the insertion opening, and the positioning holding member includes a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer.

3. The roll sheet holder according to claim 1, wherein the tape printer includes a second positioning groove provided in the upper surface of the support portion and opening upward in the feeding direction, the frontward extended portion has a lower end to be fitted in the second positioning groove when the roll sheet holder is mounted in the tape printer, thereby positioning the roll sheet holder in place in the tape printer.

4. A tape printer including a roll sheet wound on a cylindrical sheet core having a through hole opening at both ends, a feeding device which draws the roll sheet to feed an unwound part thereof, and a printing device which prints on the part of the roll sheet fed by the feeding device, the tape printer comprising:

a roll sheet holder which holds the roll sheet wound on the sheet core, the roll sheet holder including:

a guide member including a first cylindrical part which is formed with a cylindrical through hole and is fitted in one open end of the sheet core and a first flange part which is formed in an outer periphery of an outer end face of the first cylindrical part and is brought into contact with one end face of the roll sheet;

a positioning holding member which is arranged in contact with the other end face of the roll sheet and formed with a second cylindrical part on an inner surface, the second cylindrical part being fitted in the other open end of the sheet core;

a cylindrical shaft including a first end which is fitted in the through hole of the first cylindrical part of the guide member and is provided with a second flange part fixed in contact with an outer surface of the first flange part and a second end which is fitted in the second cylindrical part to be fixed to the positioning holding member; the first flange part including:

a first extended portion extending downward in a predetermined length from a lower periphery of an outer end face of the first cylindrical part, the extended portion being brought into contact with a bottom surface of the tape printer when the roll sheet holder is mounted therein; and a frontward extended portion formed extending downstream in a direction of drawing the roll sheet from the outer periphery of the outer end face of the first cylindrical part to have a front end which is located outside of an outermost surface of the roll sheet of a maximum diameter;

an insertion opening in which the unwound part of the roll sheet is inserted; and a support mechanism which removably supports the roll sheet holder in the tape printer, the support mechanism including:

a support portion which is provided upstream of the insertion opening in a direction of feeding the unwound part of the roll sheet and has an upper surface with which a lower edge of the frontward extended portion of the guide member of the roll sheet holder is brought into contact when the roll sheet holder is mounted in the tape printer;

wherein the roll sheet holder is arranged to unwind the roll sheet from above the sheet core and inserted in the insertion opening when the roll sheet holder is mounted in the tape printer.

5. The tape printer according to claim 4, wherein the positioning holding member includes a positioning rib provided protruding in a longitudinal shape on an outer surface of the positioning holding member at a substantially center of a width thereof, the support mechanism includes a positioning support member which is vertically provided in a bottom at one side end, the positioning support member including a positioning groove which opens upward and serves to place the roll sheet holder in the tape printer when the positioning rib of the positioning holding member is fitted in the positioning groove.

6. The tape printer according to claim 4, wherein the support portion includes a second positioning groove provided in the upper surface of the support portion so that a lower end of the frontward extended portion of the guide member of the roll sheet holder is fitted in the second positioning groove from above when the roll sheet holder is mounted in the tape printer, thereby positioning the roll sheet holder in place in the tape printer.

* * * * *